US011245989B2

(12) United States Patent
Nielsen et al.

(10) Patent No.: US 11,245,989 B2
(45) Date of Patent: Feb. 8, 2022

(54) HEARING AID FOR PLACEMENT IN A USER'S EAR CANAL

(71) Applicant: GN HEARING A/S, Ballerup (DK)

(72) Inventors: Henrik Nielsen, Roskilde (DK); Thomas John Chappell, Evanston, IL (US); Søren Davids, Jyllinge (DK); Shi Pu, Holte (DK); Anders Hjermø Michaelsen, Ballerup (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 16/823,304

(22) Filed: Mar. 18, 2020

(65) Prior Publication Data

US 2021/0185453 A1 Jun. 17, 2021

Related U.S. Application Data

(60) Provisional application No. 62/946,959, filed on Dec. 11, 2019.

(51) Int. Cl.
*H04R 25/02* (2006.01)
*H04R 25/00* (2006.01)

(52) U.S. Cl.
CPC ..... *H04R 25/02* (2013.01); *H04R 25/656* (2013.01); *H04R 2225/023* (2013.01); *H04R 2460/17* (2013.01)

(58) Field of Classification Search
CPC .... H04R 25/556; H04R 25/558; H04R 25/02; H04R 25/656; H04R 1/1041
See application file for complete search history.

(56) References Cited

U.S. PATENT DOCUMENTS 4,783,816 A 11/1988 Buttner et al.
7,010,137 B1 * 3/2006 Leedom ..... H04R 25/65 381/328
7,142,682 B2 * 11/2006 Mullenborn ..... H04R 19/005 381/322
7,742,614 B2 * 6/2010 Christensen ..... H01Q 9/27 381/324

(Continued)

FOREIGN PATENT DOCUMENTS

WO WO 2004/036953 4/2004

OTHER PUBLICATIONS

Kuhn, Johannes ("Contactless Push Detection for Hearing aid Controls", Siemens AG,Aug. 30, 2012) (Year: 2012).*

(Continued)

*Primary Examiner* — Sunita Joshi
(74) *Attorney, Agent, or Firm* — Vista IP Law Group, LLP

(57) ABSTRACT

A hearing aid for placement in an ear canal of a user, includes: a shell; a faceplate comprising an upper face, and a lower face, and a circumference, the upper face being exposed when the shell is placed in an ear of the user; a coil arranged at the faceplate; and a button arrangement comprising a plunger configured to control an integrated circuit arranged below the coil, the coil comprising one or more windings, the one or more windings being circumferential of an inner cavity of the coil with respect to a center or longitudinal axis of the coil, the button arrangement being configured such that the plunger in at least one position extends through the inner cavity of the coil for engaging the integrated circuit.

19 Claims, 15 Drawing Sheets

(56) References Cited

U.S. PATENT DOCUMENTS

| | | | | |
|---|---|---|---|---|
| 2004/0081328 | A1 | 4/2004 | Leedom et al. | |
| 2005/0157898 | A1 | 7/2005 | Gabathuler | |
| 2008/0164770 | A1 | 7/2008 | Terlizzi | |
| 2012/0250922 | A1* | 10/2012 | Peters | H04R 25/556 381/323 |
| 2014/0307904 | A1* | 10/2014 | Polinske | H04R 25/55 381/323 |
| 2015/0256941 | A1 | 9/2015 | Bymaster et al. | |

OTHER PUBLICATIONS

Kuhn, Johannes, "Contactless Push Detection for Hearing Aid Controls", Siemens AG, Aug. 30, 2012.
Final Office Action for U.S. Appl. No. 16/823,297 dated Aug. 6, 2021.
Non-Final Office Action for U.S. Appl. No. 16/823,297 dated Feb. 18, 2021.
Amendment Response to NFOA for U.S. Appl. No. 16/823,297 dated Jun. 16, 2021.

* cited by examiner

HEARING AID FOR PLACEMENT IN A USER'S EAR CANAL

RELATED APPLICATION DATA

This application claims priority to, and the benefit of, U.S. Provisional Patent Application No. 62/946,959, filed Dec. 11, 2019. The entire disclosure of the above application is expressly incorporated by reference herein.

TECHNICAL FIELD

The present disclosure relates to a hearing aid for placement in a user's ear canal, a charging station and a method of producing a charging station. More specifically, the disclosure relates to a hearing aid for placement in a user's ear canal, a charging station and a method of producing a charging station as defined in the introductory parts of the independent claims.

BACKGROUND ART

A problem with the solutions of the prior art is the effort of changing battery. There is thus a need for improved usability.

Custom hearing aids are hearing aids molded specifically for the ear canal of the specific user. The customized shell means that the internal volume of the hearing aid will be different for each hearing aid, and as the hearing aids are small available space is scarce for placing components affecting dimensioning, i.e. "sizing", and designing parts of the hearing aid being visible/exposed when placed in the ear.

SUMMARY

It is an object of the present disclosure to mitigate, alleviate or eliminate one or more of the above-identified deficiencies and disadvantages in the prior art and solve at least the above-mentioned problem.

In one aspect, one or more of the above objects are achieved by means of a hearing aid, as claimed in the associated independent claim, preferred variants thereof being defined in associated dependent claims.

According to a first aspect there is provided a hearing aid for placement in a user's ear canal, the hearing aid comprising a shell, a faceplate comprising an upper face and a lower face and a circumference, the upper face being exposed when the shell is placed in a user's ear, a battery, a coil arranged at the faceplate, a button arrangement comprising a plunger configured for controlling an integrated circuit arranged below the coil, the coil comprising one or more windings, the one or more windings being provided circumferential of an inner cavity of the coil with respect to a center axis of the coil, the button arrangement being configured such that the plunger in at least one position extends through the inner cavity of the coil for engaging the integrated circuit, the plunger being operable via the upper face.

According to some embodiments, the plunger is adapted to activate a push button on the integrated circuit when the plunger is pushed towards the integrated circuit. According to some embodiments, the plunger is adapted to activate a push button on the integrated circuit when the plunger is turned and/or pushed towards the integrated circuit. According to some embodiments, the push button activates or deactivates the integrated circuit when the plunger is turned and/or pushed towards the integrated circuit.

According to some embodiments, the plunger is configured as a control knob adapted to activate said integrated circuit when turned.

According to some embodiments, the button arrangement is configured to control and/or activate and/or deactivate the hearing aid.

According to some embodiments, the coil is an antenna for wireless communications and/or wireless charging a battery.

According to some embodiments, the plunger is operable through the upper face of the faceplate.

According to some embodiments, the hearing aid comprises at least two microphone arrangements.

According to some embodiments, said coil comprises a body having a cross-section being oval and/or circular and/or elliptical in a plane being perpendicular to the center/longitudinal axis of the coil.

According to some embodiments, said coil body has a cross-section being circular and/or elliptical in a plane being perpendicular to the center/longitudinal coil axis.

According to some embodiments, the shell is adapted after a user's auditory canal such that the hearing aid when placed in the ear is always orientated in a specifically predetermined position such that the time delay between sound received by the microphone arrangements gives an indication of direction from where the sound originate.

According to some embodiments, the coil and its body allow the microphone arrangements to be situated off-center and/or outside the body.

According to some embodiments, the coil and its body allow the microphone arrangements to be situated off-center and/or outside the oval and/or circular and/or elliptical and/or cylindrical shape of the body.

According to some embodiments, the microphone arrangements are essentially situated horizontally during use. According to an embodiment, the microphone arrangements of the hearing aid are situated horizontally during use. However, this of course being in dependency of the user's orientation of the head/ears.

The horizontal orientation of the hearing aid is defined relative an ear-to-ear axis being essentially parallel to or parallel to the users face, i.e. when the hearing aid is positioned at its operational position at the ear/-s of a user.

According to some embodiments, the plunger in at least one position extends through and beyond/past the length of the coil and/or the inner cavity of the coil for engaging the integrated circuit.

According to some embodiments, the plunger is at least partly made of a material being magnetizable.

According to some embodiments, said coil has a radial/extension perpendicular to its center axis being larger/greater than its longitudinal/extension along or in parallel with its centre axis.

According to some embodiments, said coil has a larger/greater width/breadth as measured in a plane perpendicular to its centre axis than its length/thickness as measured in a plane along or in parallel with its centre axis.

According to a second aspect there is provided a charging station comprising a body and a lid, wherein the charging station is configured to charge a hearing aid according to any of the disclosed aspects/example embodiments by means of induction when the hearing aid is coupled to the charging station.

According to some embodiments, the charging station comprises a coil configured for magnetizing the plunger and thereby charging the hearing aid when the charging station is coupled to the hearing aid.

According to a third aspect there is provided a method of producing a charging station according to any disclosed aspect/example/embodiment, the method comprising the steps of manufacturing a body of the charging station; providing the body with a cavity being essentially shaped as the hearing aid's shell; manufacturing a lid of the charging station; providing the lid with a cavity for receiving the hearing aid's face plate; providing the lid with a charging device, the charging device and the lid being adapted to mate such that the charging device is able to charge the hearing aid when the lid is closed.

According to some embodiments, the method comprises the steps of manufacturing a body of the charging station; providing said body with a cavity being essentially shaped as the hearing aid's shell; manufacturing a lid of the charging station; providing said lid with a cavity being essentially shaped as the hearing aid's face plate; providing said lid with a charging device, said charging device and said lid being adapted to mate such that said charging device is able to charge the hearing aid when the lid is closed.

According to a fourth aspect there is provided a charging station comprising a body and a lid, wherein the charging station is configured to charge one or more hearing aids according to any of the disclosed aspects/embodiments by means of induction when the hearing aid/-s is/are coupled to the charging station, and which body of the charging station is configured to at least roughly guide or steer or orientate or align the hearing aid/-s when introduced and received therein into position and which lid of the charging station is configured to guide or steer or orientate or align the hearing aid/-s as/when introduced/received in the charging station with a finer or vernier or final control into a final charging position of the hearing aid/-s when the lid is closed.

According to some embodiments, the shell of the hearing aid has its cavity/space opening or orifice of its inner cavity or space facing the distal end of the hearing aid, which opening the faceplate of the hearing aid is configured to close when applied thereon.

According to some embodiments, the plunger is configured as a core for its coil.

Further objects and features will appear from the following definitions of aspects/examples/embodiments thereof.

Hence, it is to be understood that the herein disclosed disclosure is not limited to the particular component parts of the device described or steps of the methods described since such device and method may vary. It is also to be understood that terminology used herein is for purpose of describing particular embodiments only, and is not intended to be limiting. It should be noted that, as used in the specification and appended claims, the articles "a", "an", "the", and "said" are intended to mean that there are one or more of the elements unless the context explicitly dictates otherwise. Thus, e.g., reference to "a unit" or "the unit" may include several devices, and the like. Furthermore, words like "comprising", "including", "containing" and similar wordings does not exclude other elements or steps.

Terminology—The term "outside" is to be interpreted as meaning that an entity is at least partly or fully (wholly) placed or arranged outside or externally of another entity.

BRIEF DESCRIPTIONS OF THE DRAWINGS

The above objects, as well as additional objects, features and advantages of the present disclosure, will be more fully appreciated by reference to the following illustrative and non-limiting detailed description of example embodiments of the present disclosure, when taken in conjunction with the accompanying drawings.

Figure 1A:
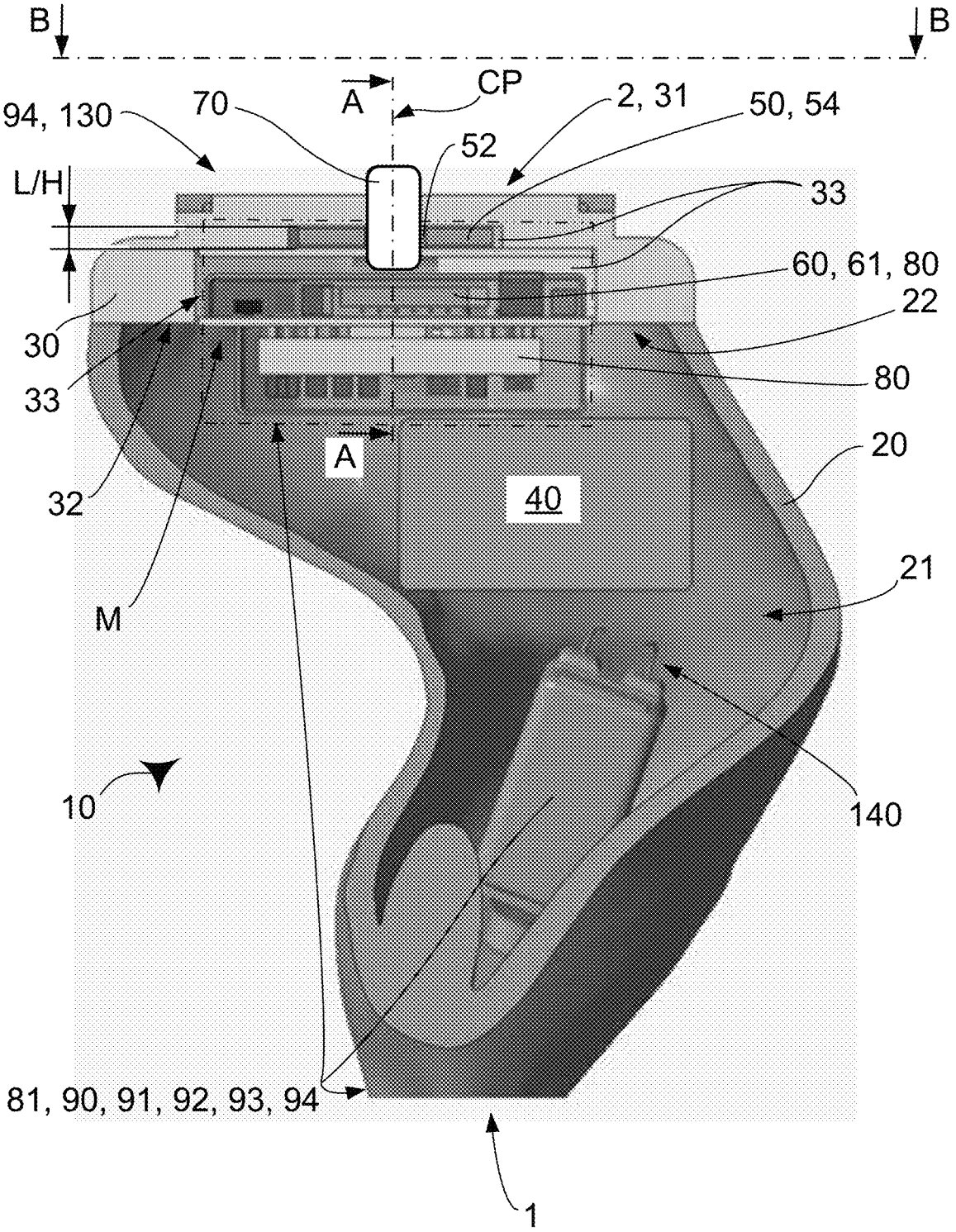
FIG. 1A shows a side view in cross-section of the hearing aid according to an embodiment of the present disclosure.
Figure 1B:
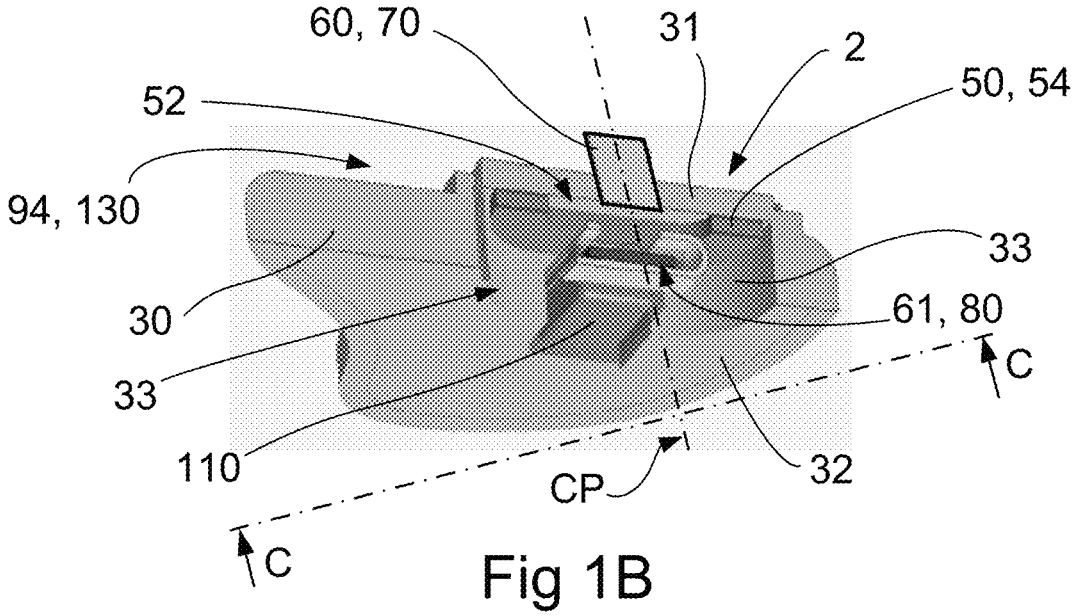
FIG. 1B shows a perspective view in cross-section of a faceplate of the hearing aid according to an embodiment of the present disclosure.
Figure 1C:
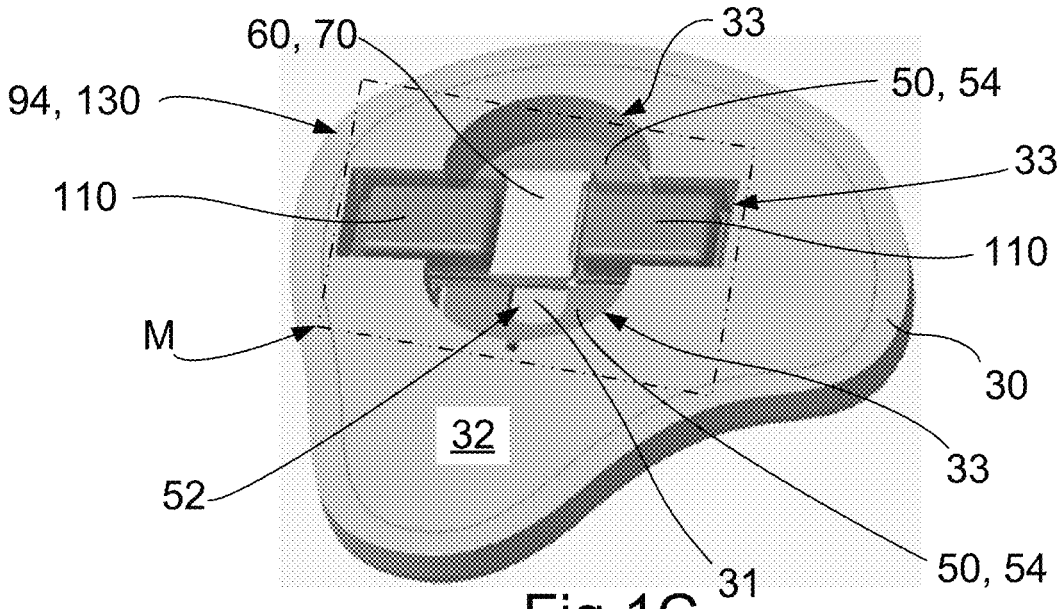
FIG. 1C shows the faceplate of the hearing aid of FIG. 1B from the underside according to an embodiment of the present disclosure.
Figure 1D:
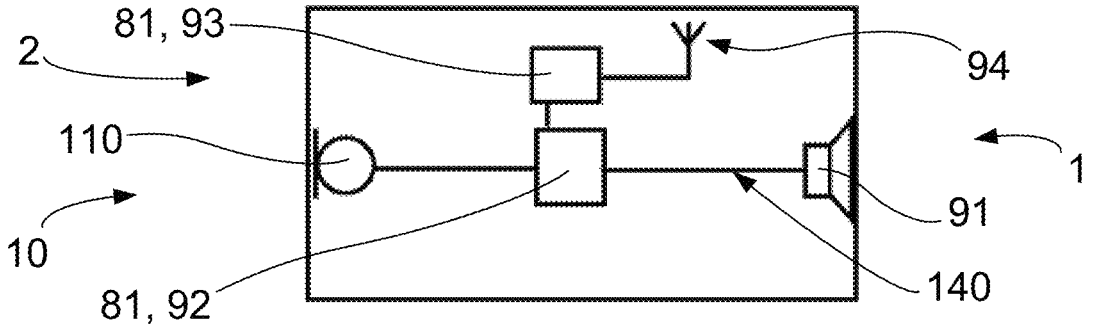

FIG. 1D schematically illustrates an example of a hearing aid according to an embodiment of the present disclosure.

Figure 2A:
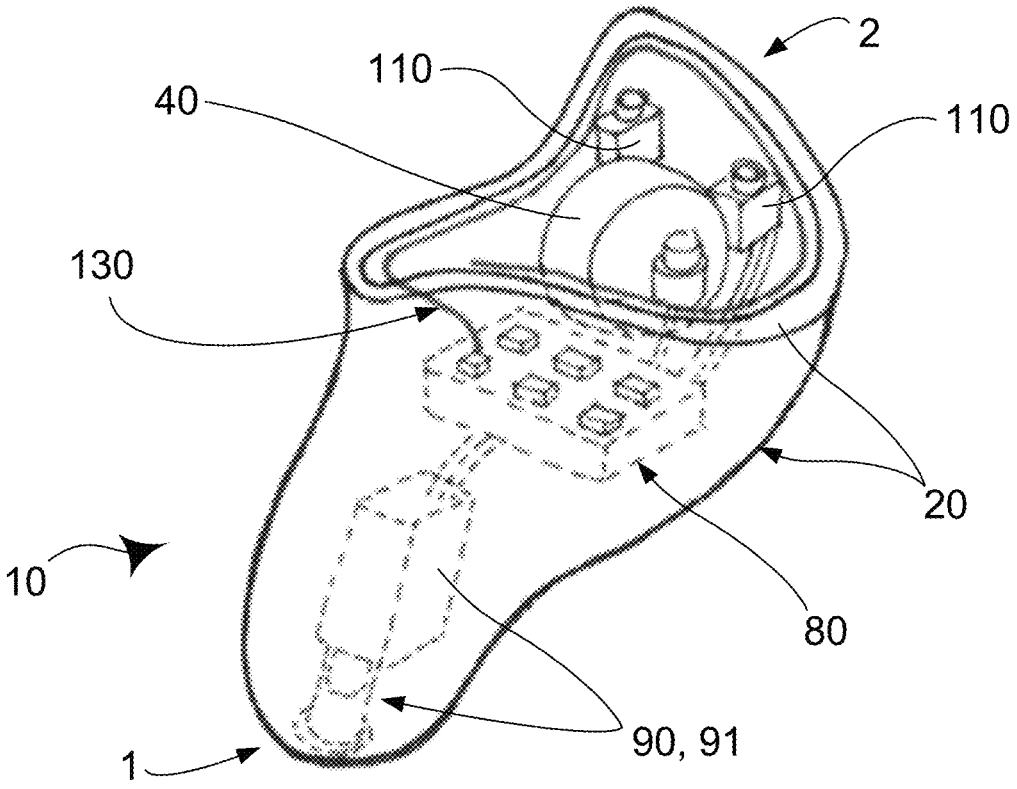

FIG. 2A shows a hearing aid shell in perspective according to an example of prior art.

Figure 2B:
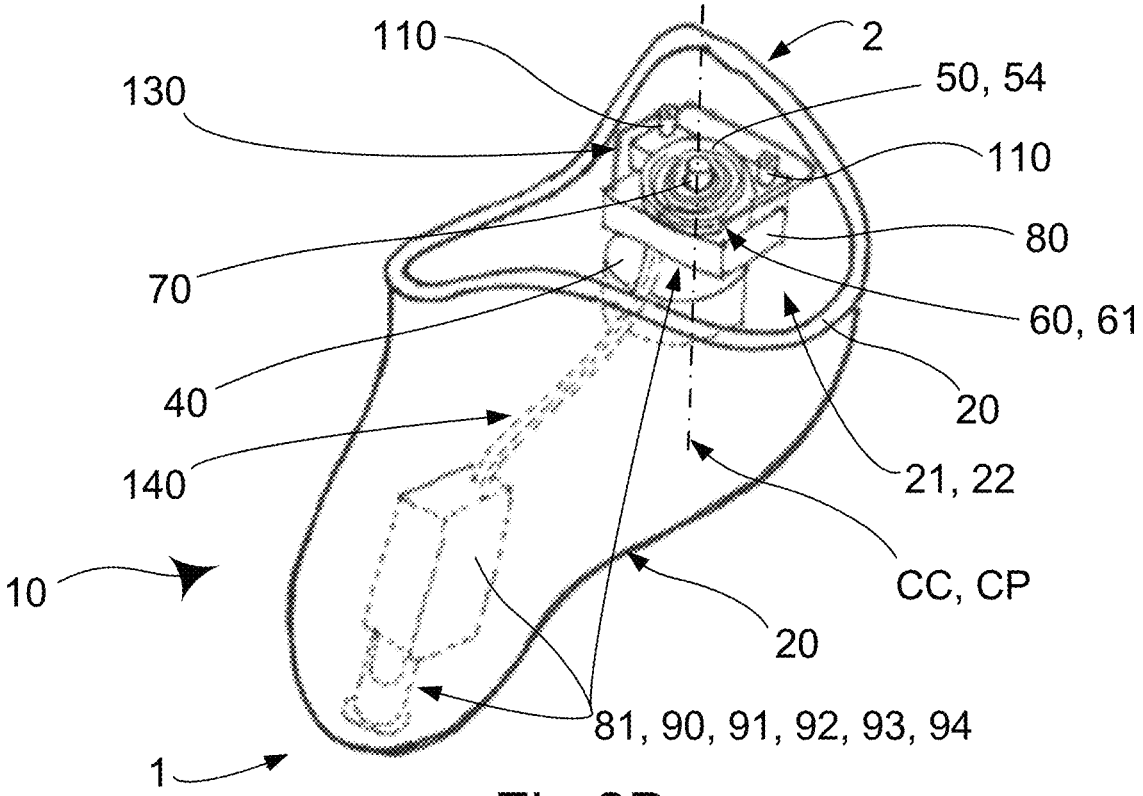

FIG. 2B shows a shell of the hearing aid in perspective according to an embodiment of the present disclosure.

Figure 3:
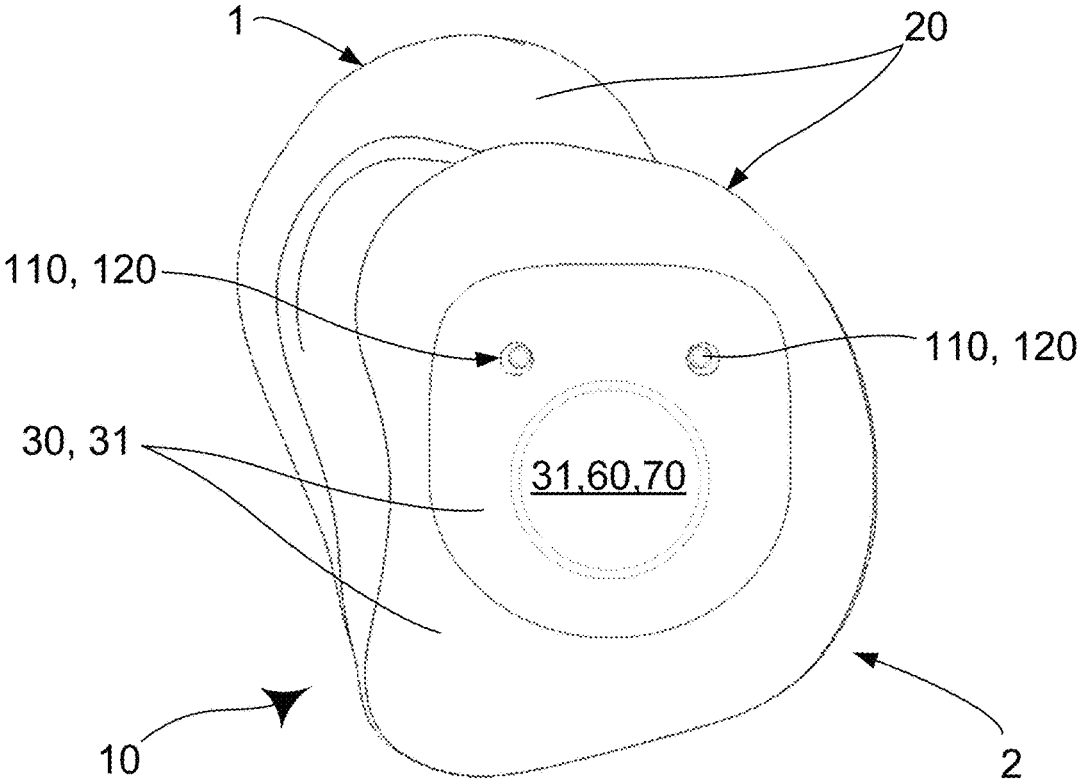

FIG. 3 shows the hearing aid in a top view (towards the faceplate of the hearing aid) according to an embodiment of the present disclosure.

Figure 4A:
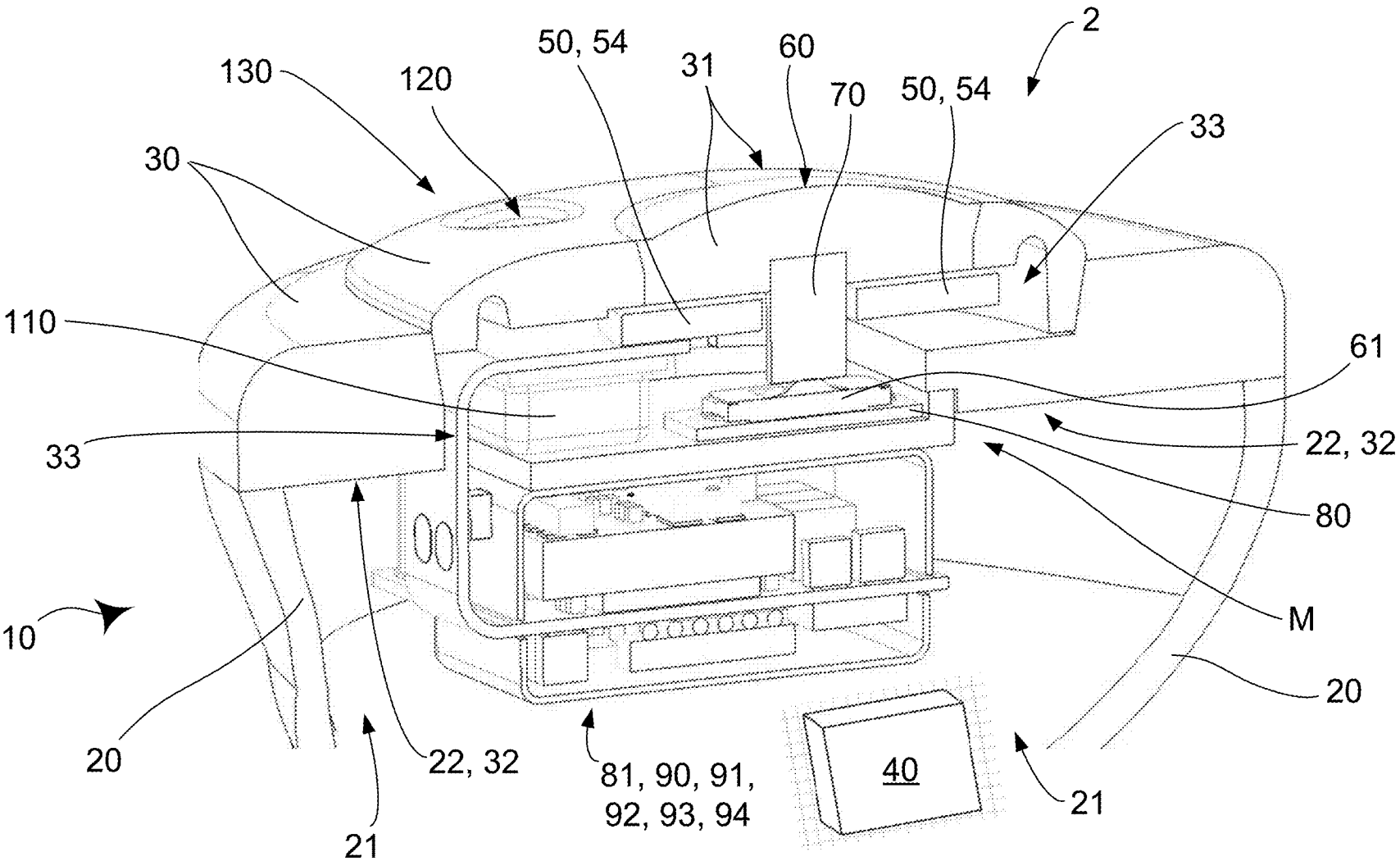

FIG. 4A shows a cross-sectional view in perspective of the hearing aid according to an embodiment of the present disclosure.

Figure 4B:
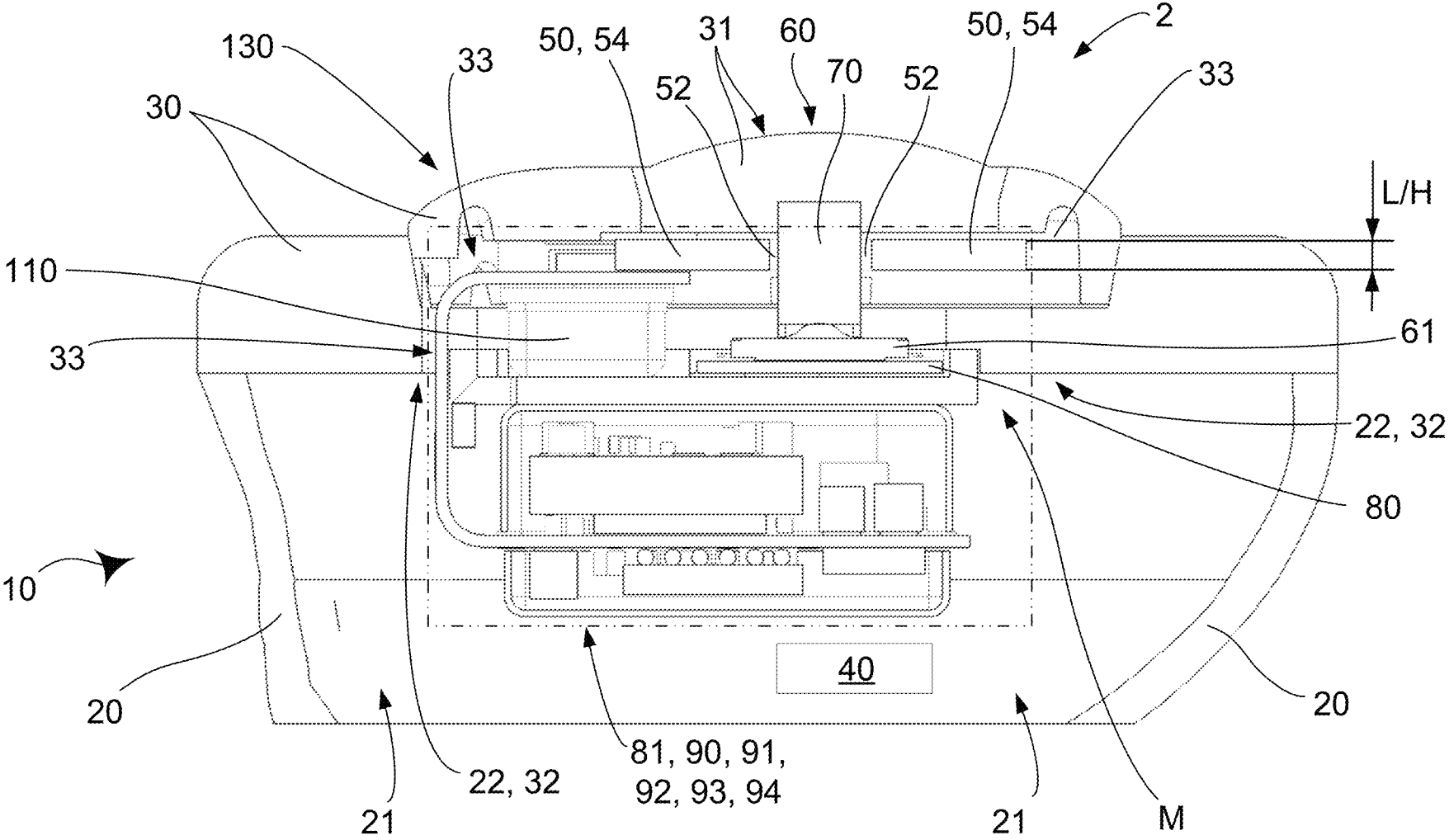

FIG. 4B shows a side view of a cross-section of the hearing aid according to an embodiment of the present disclosure.

Figure 4C:
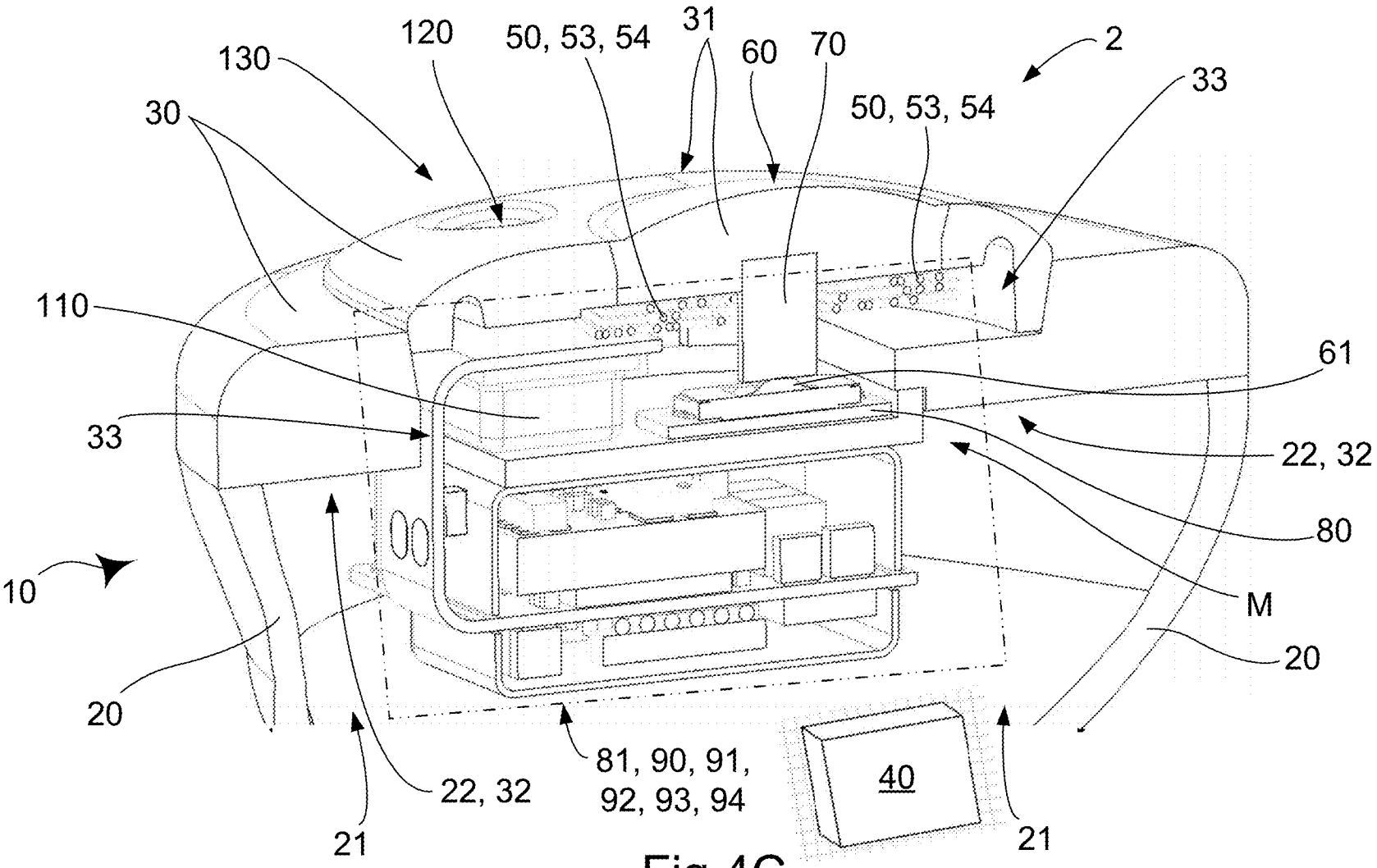

FIG. 4C shows a cross-sectional view in perspective of the hearing aid according to an embodiment of the present disclosure.

Figure 4D:
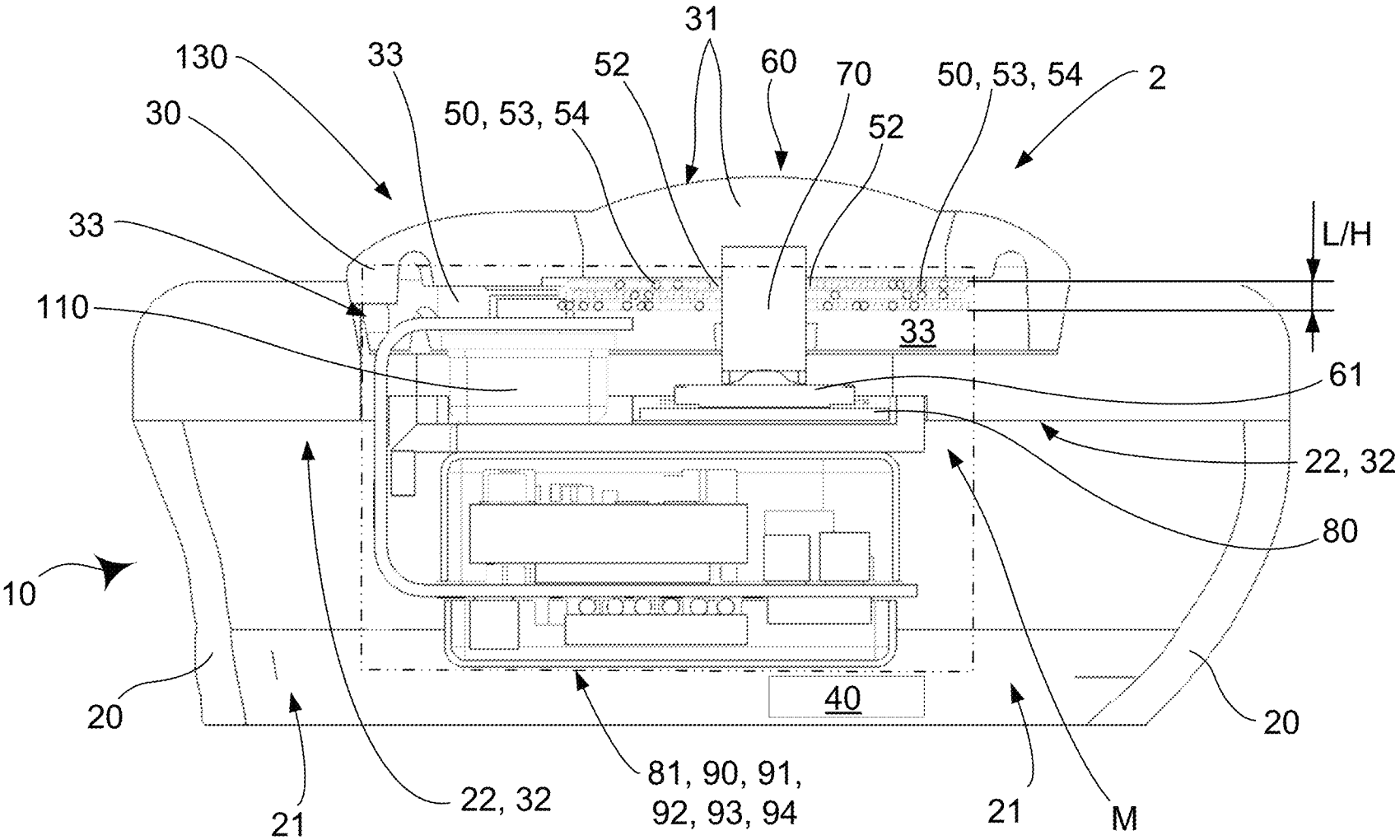

FIG. 4D shows a side view of a cross-section of the hearing aid according to an embodiment of the present disclosure.

Figure 4E:
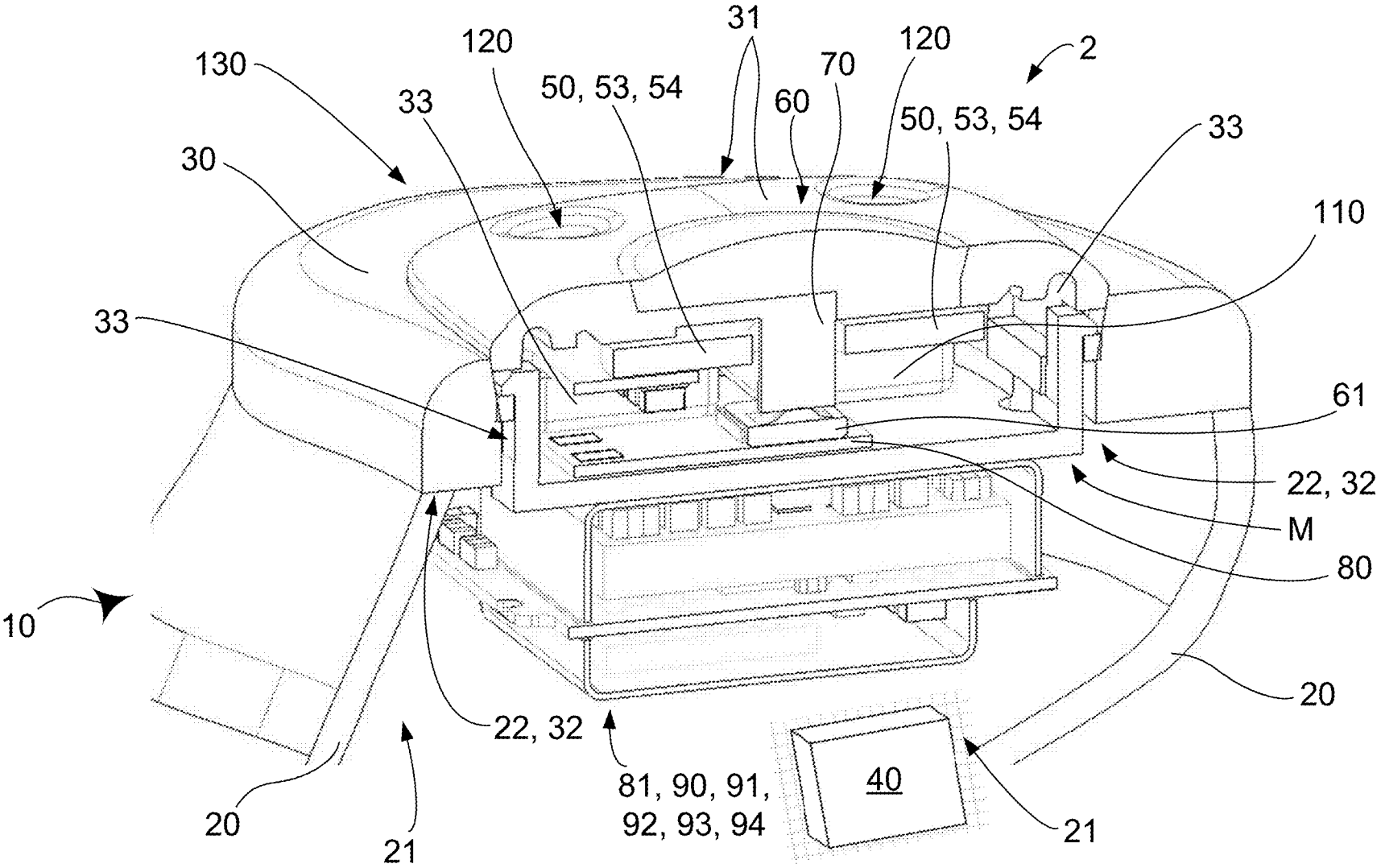

FIG. 4E shows a cross-sectional view in perspective of the hearing aid according to an embodiment of the present disclosure.

Figure 4F:
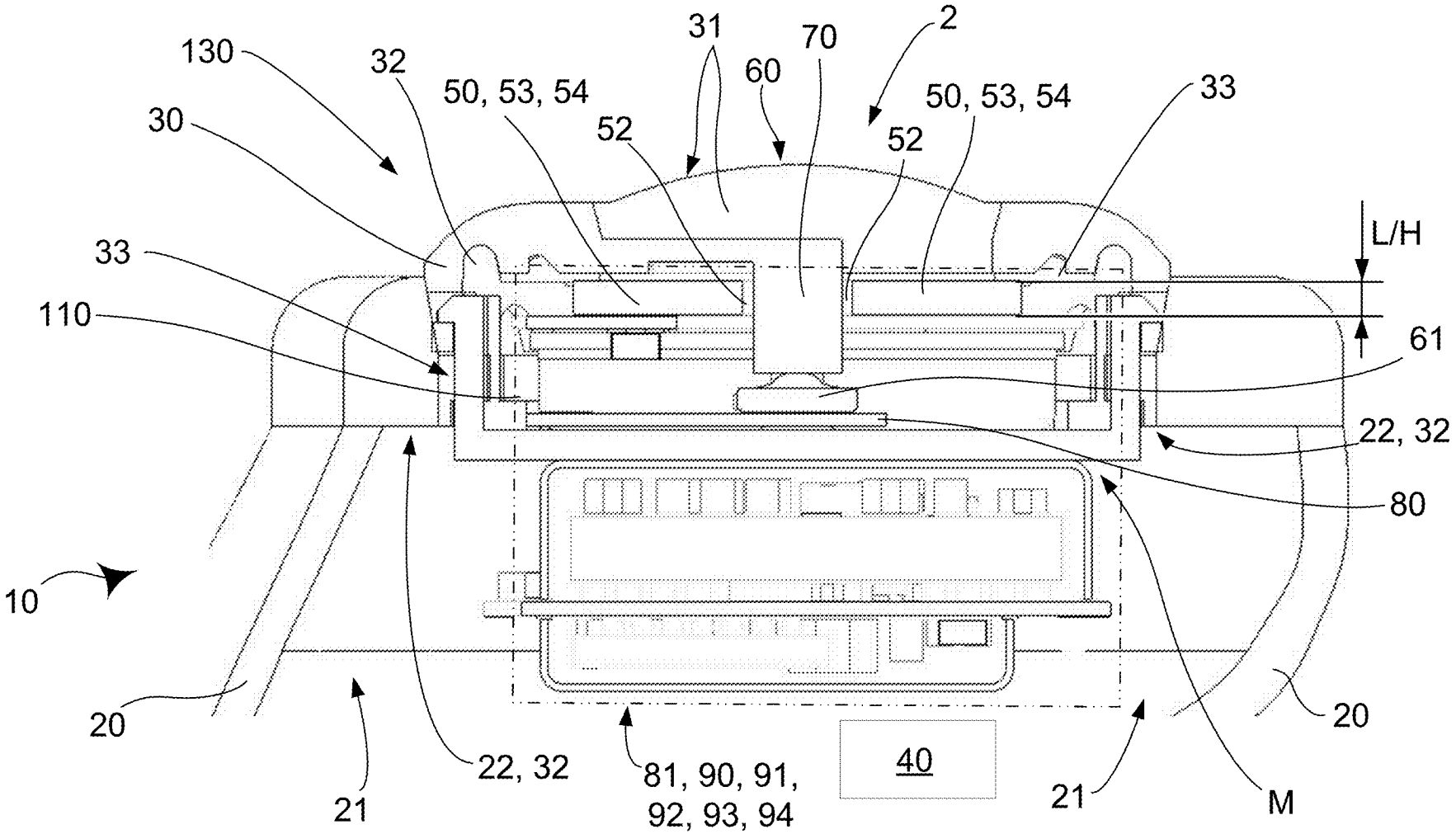

FIG. 4F shows a side view of a cross-section of the hearing aid according to an embodiment of the present disclosure.

Figure 5A:
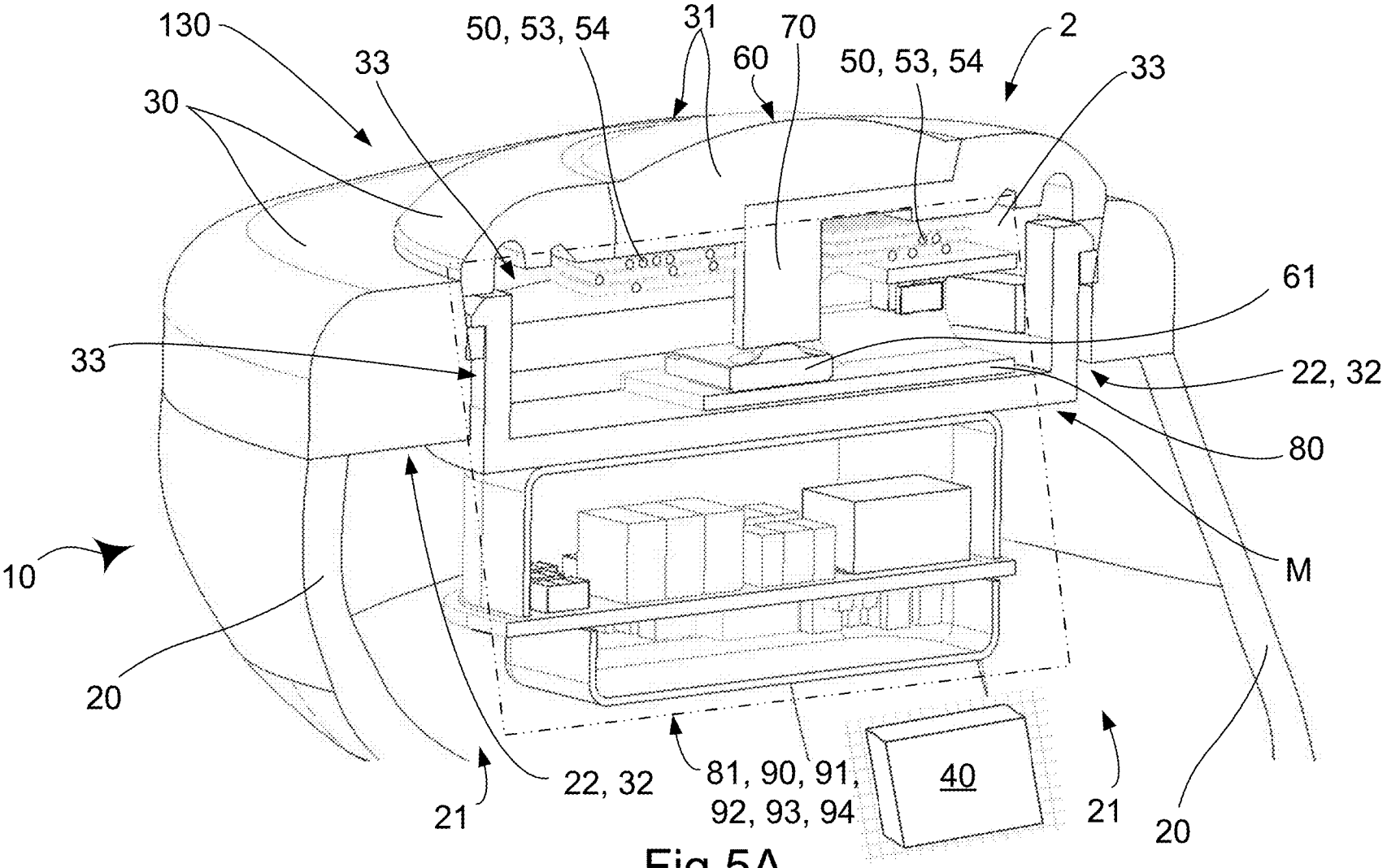

FIG. 5A shows a cross-sectional view in perspective of the hearing aid according to an embodiment of the present disclosure.

Figure 5B:
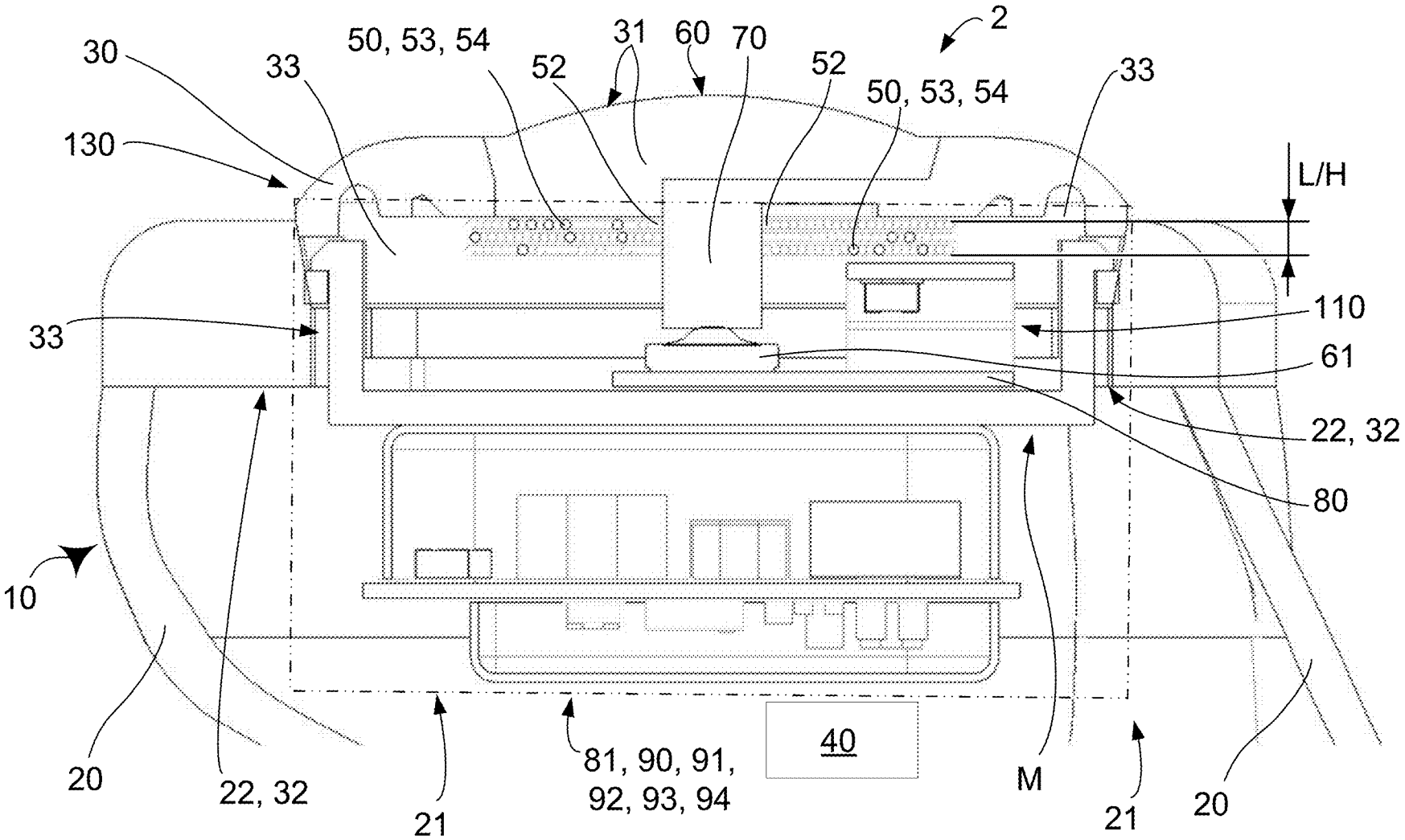

FIG. 5B shows a side view of a cross-section of the hearing aid according to an embodiment of the present disclosure.

Figure 5C:
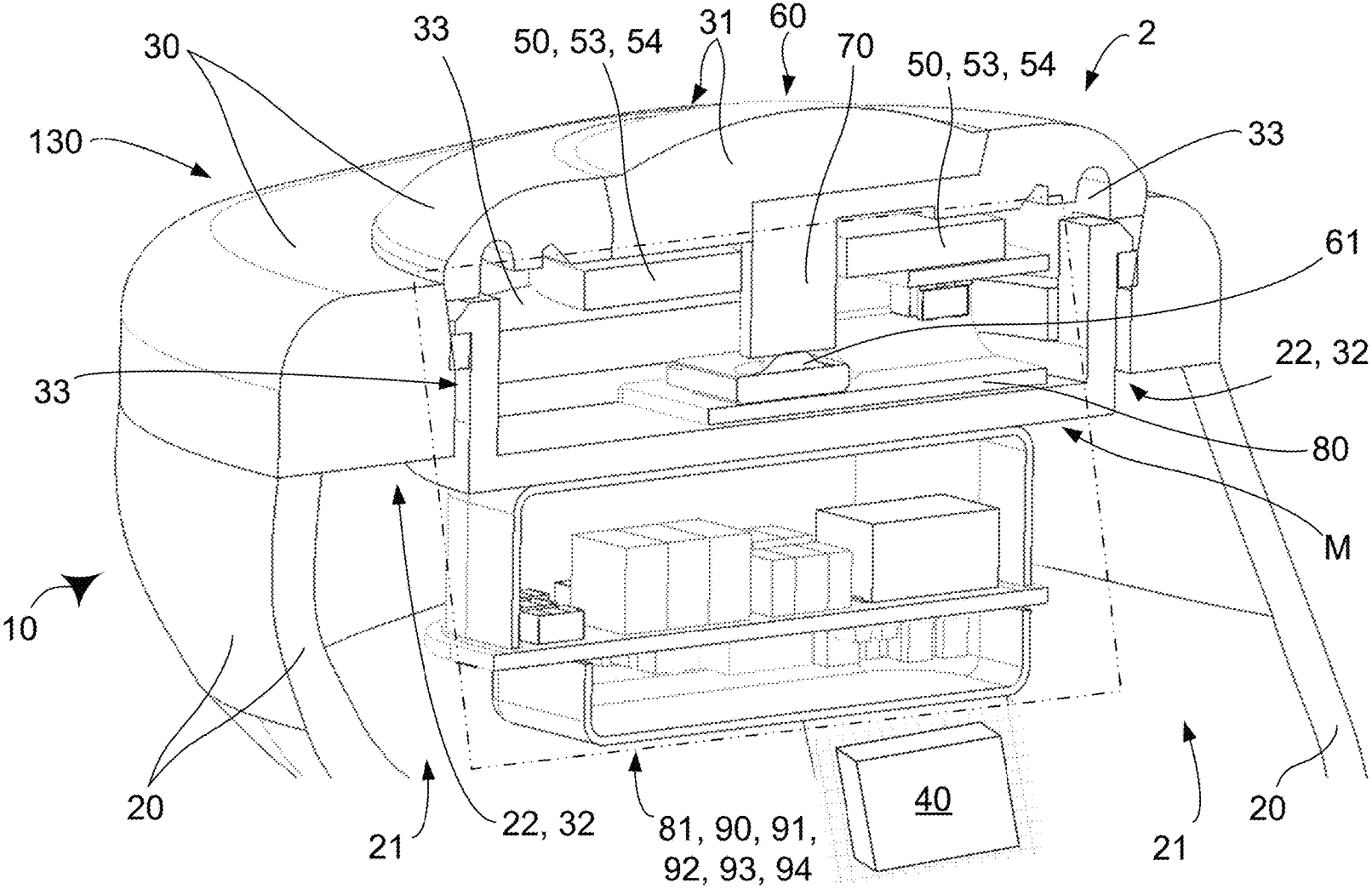

FIG. 5C shows a cross-sectional view in perspective of the hearing aid according to an embodiment of the present disclosure.

Figure 5D:
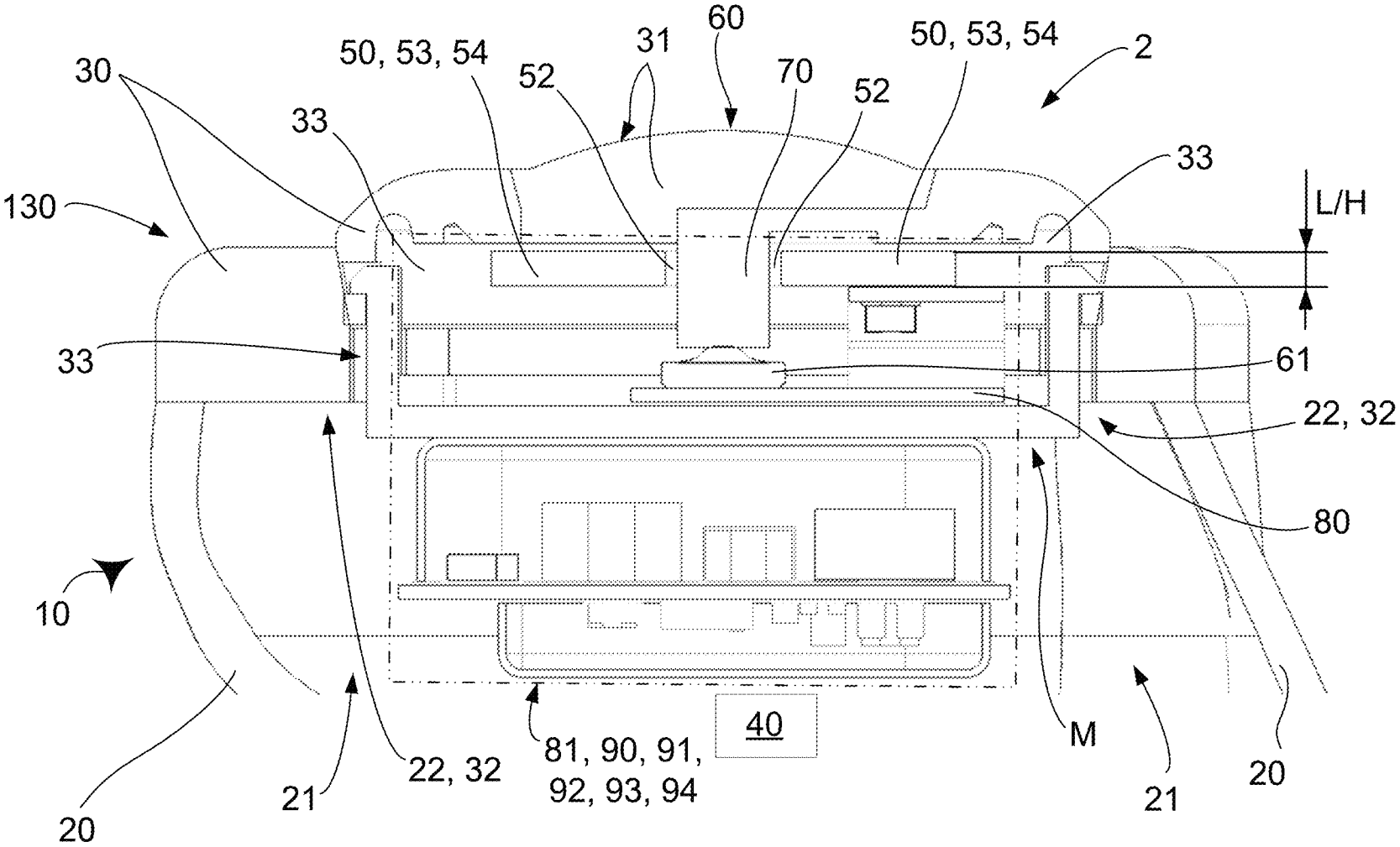

FIG. 5D shows a side view of a cross-section of the hearing aid according to an embodiment of the present disclosure.

Figure 6A:
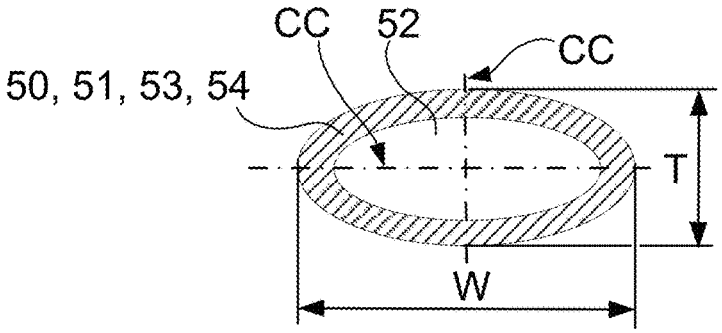

FIG. 6A shows a cross-sectional planar view from above of a coil of the hearing aid according to an embodiment of the present disclosure.

Figure 6B:
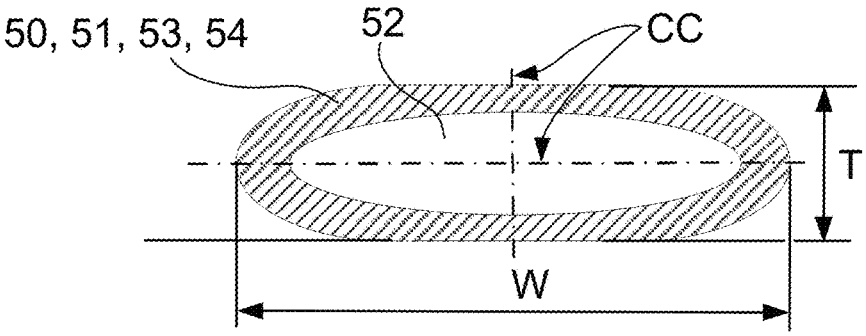

FIG. 6B shows a cross-sectional planar view from above of a coil of the hearing aid according to another embodiment of the present disclosure.

Figure 7:
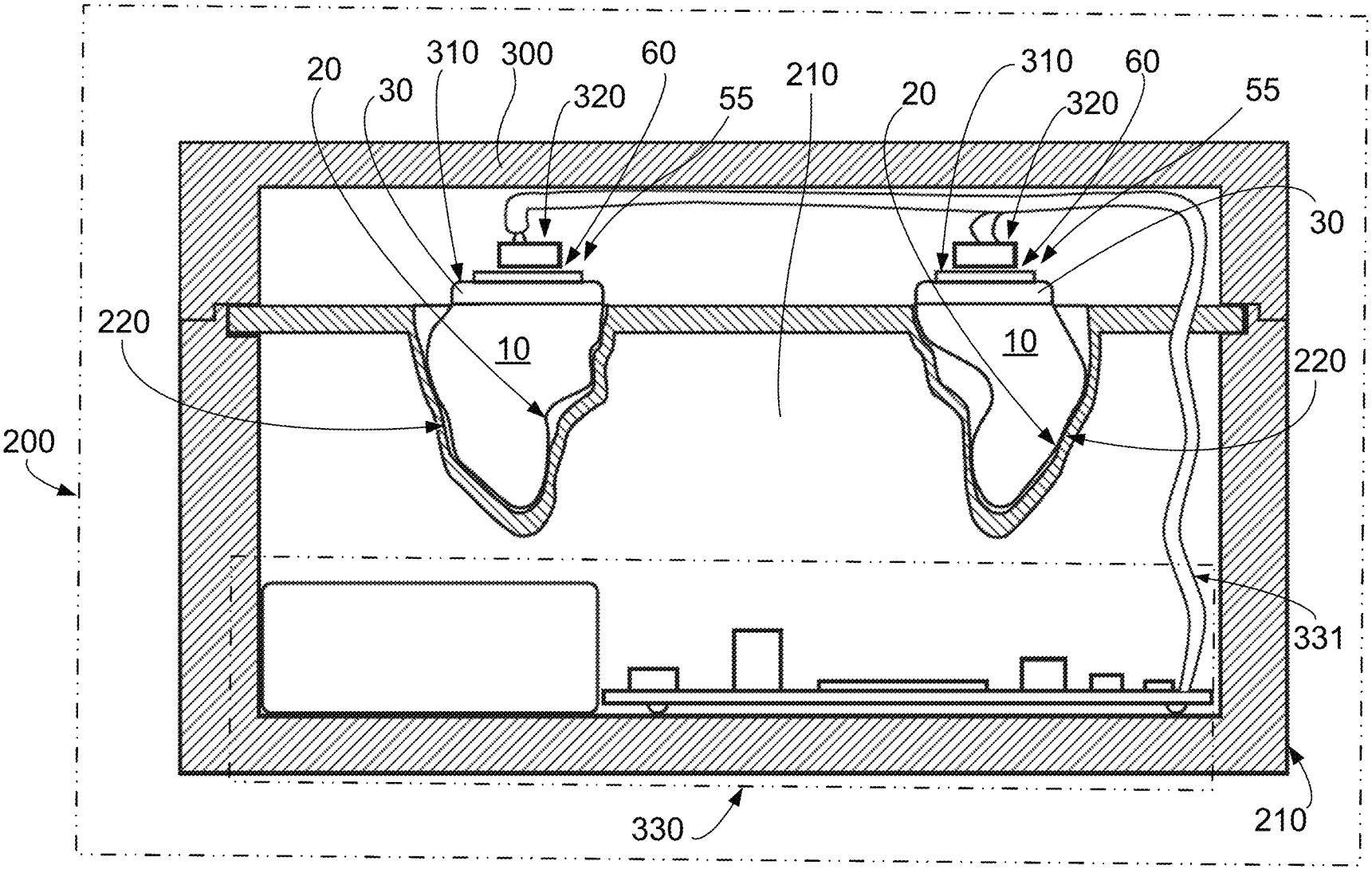

FIG. 7 shows a side view of a cross-section of a charging station according to an embodiment of the present disclosure.

DETAILED DESCRIPTION

The present disclosure will now be described with reference to the accompanying drawings, in which preferred example embodiments of the disclosure are shown. The disclosure may, however, be embodied in other forms and should not be construed as limited to the herein disclosed embodiments/examples. The disclosed embodiments are provided to fully convey the scope of the disclosure to the skilled person. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiment/-s even if not so illustrated, or if not so explicitly described. Throughout, the same reference numerals are used for identical or corresponding parts.

The present description provides an improved hearing aid 10 for placement in user's ear canal, a charging station 200 and method of producing a charging station. According to an example embodiment there is provided a hearing aid 10 for placement in a user's ear canal. The hearing aid 10 has a proximal end 1 and a distal end 2. The proximal end 1 is the end of the hearing aid 10 that is inserted into the user's ear canal and facing the tympanic membrane when inserted, the distal end 2 is the opposite end.

The hearing aid 10 comprises a shell 20. The shell 20 is customised for the user's ear canal. The shell 20 comprises an inner space 21 configured for at least partly or wholly/fully receiving a rechargeable battery 40 for powering the hearing aid 10. The hearing aid 10 comprises a faceplate 30 comprising an upper face 31 and a lower face 32 and a circumference. The upper face 31 is exposed at the distal end 2 of the hearing aid 10 when the shell 20 is placed in a user's ear. The hearing aid 10 comprises a coil 54 arranged at the faceplate 30, a button arrangement 60, 61 comprising a plunger 70 configured for controlling an integrated circuit (IC) 80 arranged below the coil 54. The coil 54 is in one embodiment part of a charging arrangement 50. The coil 54 comprises one or more windings 53. The one or more windings 53 are provided circumferential of an inner cavity 52 of the coil 54 with respect to a center/longitudinal axis CC of the coil. The button arrangement 60, 61 is configured such that the plunger 70 in at least one position extends through the inner cavity 52 of the coil 54 for engaging the IC 80, which plunger is operable via the upper face 31 of the faceplate 30.

The inner space 21 is in some embodiments, not all, configured for at least partly receiving the charging arrangement 50. In some embodiments, not all, the inner space 21 is configured for facing and/or at least partly receiving at least one microphone arrangement 110 and/or at least partly receiving one audio channel 120. One or more audio channels 120 are provided to guide sound to the microphone/-s of the microphone arrangement/-s 110. In some embodiments, the inner space 21 is configured for at least partly receiving the IC 80.

The faceplate 30 of the hearing aid 10 is configured for closing the inner shell space 21. The IC 80 is configured to be arranged between the faceplate 30 and the proximal hearing aid end 1. The shell 20 comprises an opening or orifice 22 at and facing towards the distal hearing aid end 2. The charging arrangement 50 is configured to be situated at the distal hearing aid end 2. The battery 40 is configured to be situated between the IC 80 and the proximal end 1. The shell opening/orifice 22 is configured to be closed off by the faceplate 30 when assembled against the shell 20 at the distal hearing aid end 2 to make up the whole hearing aid 10. The shell opening/orifice 22 is configured to be closed off by the faceplate 30 and these entities are sealingly assembled when/after making up the hearing aid 10.

In an example/embodiment, the plunger 70 is adapted to activate one or more push buttons 61 on the integrated circuit 80 when the plunger is pushed towards the IC 80.

According to an example, the charging arrangement 50 and the at least one microphone arrangement 110 are produced as one module M, see FIGS. 1A, 1C, 2B, 4A, 4B, 4C, 4D, 4F, 5A, 5B, 5C and 5D. According to an example, the faceplate 30 comprises a cavity 33 at its lower face 32 for at least partly receiving said module 50, 110, M. The faceplate cavity 33 is configured for facing and/or closing the inner space 21 of the shell 20 similar to a lid then being sealed. According to an example, the charging arrangement 50 comprises a coil 54. The coil 54 being configured for wireless communication and/or wireless charging of the battery 40. According to an example, the charging arrangement 50 comprises terminals 55 extending at the upper face 31 of the faceplate 30. According to an example, hearing aid 10 comprises a button arrangement 60 that in turn comprises the plunger/-s 70. The plunger/-s 70 is/are operable through the upper face 31 of the faceplate 30. In an example, the plunger/-s 70 is/are adapted to activate one or more push buttons 61 on the IC 80 when the plunger/-s is/are pushed towards the IC. According to an example, the button arrangement 60 comprises the plunger/-s 70 and/or the push button/-s 61. In an example, the plunger/-s 70 and push button/-s 61 are separate entities or part of the same entity or integral parts that could be fixed or movable at least somewhat relative each other. In an example, the plunger/-s 70 and/or push button/-s 61 is/are part of the faceplate 30 and/or the IC 80 or integrated in the faceplate and/or in the IC. In an example, the plunger/-s 70 and/or push button/-s 61 is/are part of the faceplate 30 or integrated in the faceplate and movable at least somewhat relative each other and/or the face plate 30 and/or the IC 80 to ensure their engagement and disengagement with the IC 80 for its control and/or activation/deactivation.

According to an example, the coil 54 comprises one or more windings 53. The one or more windings 53 are provided circumferential of an inner cavity 52 of the coil 54 with respect to a center or longitudinal axis CC of the coil. According to an example, the plunger 70 is configured to extend through the inner coil cavity 52 along the coil center/longitudinal axis CC to access the IC 80. The plunger 70 is in one example a single push button. In one example, the plunger 70 is a rocker arm with two circuits or the like. According to an example, one or more of the windings 53 of the coil 54 is/are configured to extend radially and/or axially around the inner coil cavity 52. As examples, the plunger/-s 70 is a push button preferably being spring biased to be forced back to its initial position after pushing force ends. Alternatively, the plunger/-s 70 is a rocker arm. A rocker arm 70 is a flexible and/or jointed/hinged arm, which will spring back to its initial position once the pushing force is gone. The plunger/-s 70 and/or rocker arm may activate a push button 61 on the IC 80 or have a metallic tip which closes a circuit when coming into contact with an opposite part of a switch or the like on the IC.

According to an example, the plunger 70 is configured as a control knob adapted to activate the IC 80 when turned. According to an example, the button arrangement 60, 61, 70 is configured to activate or deactivate the hearing aid 10 and/or change program and/or change audio filtering and/or volume (down/up) and/or power (down/up) and/or turn it on or off via the IC 80 or one or more like component/-s, such as further control units 81, 92.

According to an embodiment, the coil 54 is an antenna 130 for wireless communication. According to an embodiment, the coil 54 is configured for charging the battery 40 wirelessly. According to an embodiment, the coil 54 is an antenna 130 for wireless communication and configured for charging the battery 40 wirelessly.

According to an example, the hearing aid 10 comprises at least two microphone arrangements 110. According to examples, one, both or each microphone arrangement 110 comprises at least one associated audio channel 120, see FIGS. 3, 4A, 4C and 4E.

According to an example, the coil 54 comprises a body 51 having a cross-section being rounded and/or oval in a plane perpendicular to its center/longitudinal axis CC and/or the center/longitudinal axis CP of the plunger 70, see e.g. FIGS. 1B, 1C, 6A and 6B.

According to an example, said coil body 51 has a cross-section being circular and/or elliptical in a plane perpendicular to the center/longitudinal axis CC, see e.g. FIGS. 1B and 2B.

The orientation and/or extension of the cross-sectional plane of the coil 54 could be diverging from/in relation to the center/longitudinal coil axis CC and/or the center/longitudinal axis CP of the plunger 70 at any other angle besides about 90° or exactly 90°, e.g. at an angle of between about 10° to 80° or between 10° to 80°; or at an angle of between about 20° to 70° or between 20° to 70°; or at an angle of between about 30° to 60° or between 30° to 60°; or at an angle of between about 40° to 50° or between 40 to 50°; or at an angle of about 45° or exactly 45°.

In an example, the shell 20 is adapted after a user's auditory canal so that each hearing aid 10 when placed in the ear is always orientated in a specifically predetermined position such that the time delay between sound received by the microphone arrangement/-s 110 and audio channel/-s 120 give/-s an indication of direction from where the sound originate.

According to an example, the coil 54/its body 51 allows the microphone arrangement/-s 110 to be situated off-center and/or outside the body. According to an example, the coil 54 and its body 51 allow the microphone arrangement/-s 110 to be situated off-center and/or outside the cylindrical body. According to an example, the coil 54 and its body 51 allow the microphone arrangement/-s 110 to be situated off-center and/or outside the oval shape. According to an example, the coil 54 with body 51 allow the microphone arrangement/-s 110 to be situated off-center and/or outside the circular and/or elliptical shape of the body.

According to an example embodiment there is provided a hearing aid 10, wherein the microphone arrangement/-s 110 are essentially situated horizontally during use. The horizontal orientation of the hearing aid 10 is defined relative an ear-to-ear axis being essentially parallel to or parallel to the users face, i.e. when the hearing aid 10 is positioned at its operational position at the ear/-s of a user.

According to an example, the plunger 70 in at least one position extends through and beyond/past the length/height/thickness L/H of the coil 54 for engaging the IC 80.

According to an example, the plunger 70 is at least partly or wholly made of a material being magnetizable. According to an example, the plunger 70 is at least partly or wholly made of a magnetic material. This improves the performance of the coil 54 and associated entities when the coil is used as a magnetic induction antenna.

According to an example, the coil 54 has a radial/(physical) extension W/T perpendicular to its centre axis CC being larger/greater than its longitudinal/(physical) extension L/H along or in parallel with its centre axis CC.

According to an example, the coil 54 has a larger/greater width/breadth/thickness W/T as measured in a plane perpendicular to its centre axis CC than its length/height L/H as measured in a plane along or in parallel with its centre axis CC, see e.g. FIGS. 1A, 4B, 4D, 4F, 5B, 5D, 6A and 6B.

According to an example embodiment there is provided a charging station 200 comprising a body 210 and a lid 300, wherein the charging station is configured to charge one or more hearing aids 10 simultaneously and/or in parallel and/or in series and/or one by one and/or only one or two at a time according to any former or latter aspects/examples by means of induction when the hearing aid/-s is/are coupled to the charging station.

According to an example, the charging arrangement 50 comprises a coil 54 configured for magnetizing the plunger 70 and thereby charging the hearing aid 10 when the charging station 200 is coupled to the hearing aid.

According to an aspect there is provided a method of producing a charging station 200 comprising the steps of manufacturing a body 210 of the charging station; providing the body 210 with a cavity 220 being essentially shaped as the hearing aid's shell 20; manufacturing a lid 300 of the charging station 200; providing the lid with a cavity 310 for abutting and/or contacting/touching and/or engaging and/or enclosing and/or covering and/or receiving the hearing aid's faceplate 30; providing the lid with a charging device 320, the charging device 320 and the lid 300 being adapted to mate such that the charging device 320 is able to charge the hearing aid 10 when the lid 300 is closed.

According to an example, the method comprises the steps of manufacturing a body 210 of the charging station 200; providing said body with a cavity 220 being essentially shaped as the hearing aid's shell 20; manufacturing a lid 300 of the charging station; providing the lid 300 with a cavity 310 being essentially shaped for receiving the hearing aid's faceplate 30; providing said lid with a charging device 320, the charging device 320 and the lid 300 being adapted to mate such that the charging device 320 is able to charge the hearing aid 10 when the lid 300 is closed. The charging device/-s 320 of the charging station/-s 200 and the charging arrangement/-s 50, 54 of the hearing aid/-s 10 are configured to be operatively controlled to cooperate to enable the charging functionality without direct physical contact between electrical conductors, i.e. by contactless charging, e.g. via induction.

FIG. 1A shows an embodiment of the disclosure. FIGS. 1B and 1C show the embodiment of FIG. 1A in two different perspectives, i.e. FIG. 1B shows the faceplate 30 partly in cross-section essentially in the direction of arrows A and in perspective somewhat angled in relation to the plane of the faceplate 30 and the longitudinal axis CP of the plunger/button 70, while FIG. 1C shows the faceplate 30 in FIG. 1B from below in the direction of arrows C of FIGS. 1B and 1*n* perspective, i.e. essentially in parallel with or at least almost in alignment with/along the longitudinal axis CP of plunger or button 70. FIG. 2A shows a prior art hearing aid shell 20. FIG. 2B shows an embodiment of the disclosure. FIG. 3 shows the embodiment of FIGS. 1A-C in direction of arrows B, i.e. perpendicular to the plane of the faceplate 30 but along the longitudinal axis CP of the plunger/button 70. FIGS. 4A and 4B show an embodiment of the disclosure from two different perspectives and as part cutouts, i.e. FIG. 4A shows the same embodiment as in FIG. 4B but in perspective, i.e. FIG. 4B shows the same embodiment as in FIG. 4A but in planar view. FIGS. 4C and 4D show an embodiment of the disclosure from two different perspectives and as part cutouts, i.e. FIG. 4C shows the same embodiment as in FIG. 4D but in perspective, i.e. FIG. 4D shows the same embodiment as in FIG. 4C but in planar view. FIGS. 4E and 4F show an embodiment of the disclosure from two different perspectives and as part cutouts, i.e. FIG. 4E shows the same embodiment as in FIG. 4F but in perspective, i.e. FIG. 4F shows the same embodiment as in FIG. 4E but in plane view. FIGS. 5A and 5B show an embodiment of the disclosure from two different perspectives and as part cutouts, i.e. FIG. 5A shows the same embodiment as FIG. 5B but in perspective, i.e. FIG. 5B shows the same embodiment as in FIG. 5A but in plane view. FIGS. 5C and 5D show an embodiment of the disclosure from two different perspectives and as part cutouts, i.e. FIG. 5C shows the same embodiment as in FIG. 5D but in perspective, i.e. FIG. 5D shows the same embodiment as in FIG. 5C but in a planar view. FIGS. 6A and 6B show differently shaped embodiments of the coil 54 in planar cross-sectional views. FIG. 7 shows an embodiment of a charging station 200 in cross-section.

The first aspect of this disclosure shows a hearing aid 10 for placement in a user's ear canal, the hearing aid comprising a shell 20 and a faceplate 30. The faceplate 30 comprises an upper face 31 and a lower face 32 and a circumference. The upper face 31 is exposed when the shell 20 is placed in a user's ear. The hearing aid 10 comprises further a rechargeable battery 40, a charging arrangement 50 comprising a coil 54 arranged at the faceplate 30 and a button arrangement 60 comprising a plunger 70 configured for controlling an integrated circuit (IC) 80 arranged below the coil 54. The shell 20 comprises an inner space 21. The faceplate 30 is configured for closing the inner shell space 21. The IC 80 is arranged between the faceplate 30 and the proximal end 1. The charging arrangement 50 is situated at the distal hearing aid end 2. The battery 40 is situated between the IC 80 and the proximal end 1.

The charging arrangement 50, 54 and at least one microphone arrangement 110 are produced as one module M in an embodiment. The charging arrangement 50, 54 and two microphone arrangements 110 are produced as one module M in an embodiment. The charging arrangement 50, 54, two microphone arrangements 110 and optionally at least one button arrangement 60, 61, 70 are produced as one module M in an embodiment. In an embodiment, the charging arrangement 50 and its coil 54, at least one microphone arrangement 110 and at least one button arrangement 60, 61, 70 are produced as one module M. In an embodiment, the charging arrangement 50 and its coil 54, at least one microphone arrangement 110, at least one button arrangement 60, 61, 70 and at least one 2.4 GHz antenna are produced as one module M. In an embodiment, such a solution above and/or below creates a new standardized architecture module enabling fixating at least the entities 50, 54 and 110, i.e. the charging arrangement and the microphone arrangement/-s, in the faceplate 30 as one module M. In an embodiment, any of the above and/or below solutions simplifies/-y access of at least the following entities: the charging arrangement 50, 54 and the microphone arrangement/-s 110 and, optionally, the button arrangement 60, 61, 70 from the faceplate 30 enabling program switching and/or charging and/or sound intake and/or sound output and/or control of wireless performance of the hearing aid 10. In an embodiment, a module M comprising at least the charging arrangement 50, 54 and the microphone arrangement/-s 110 eliminate the need of a battery opening in the faceplate 30. In an embodiment, a module M comprising the charging arrangement 50 with its coil 54 and the microphone arrangement/-s 110 and optionally comprising at least one button arrangement 60, 61, 70 optimise/minimise the design/size of the faceplate 30. In an embodiment, a module M comprising the charging arrangement 50 and/or a button arrangement 60/button 61 and/or a plunger 70 and the microphone arrangement/-s 110 provide a more flexible architecture of the hearing aid 10 and the components making it up where placement of components of the hearing aid 10 are defined by their required position, so they perform as intended. In an embodiment, a module M comprising the charging arrangement 50 and/or button arrangement 60, 61 and/or the plunger 70 and the microphone arrangement/-s 110 provide placing components within the hearing aid 10 that do not require a specific position more freely where space is available in the shell 20 and finally the custom hearing aid 10 is possible to make more environmental robust as it then is easily closed and/or sealed. A module M optimizes use/filling of already existing empty space through the coil 54, thereby improving the filling grade of the hearing aid 10. The shell 20 and faceplate 30 of the hearing aid 10 is in an embodiment fixed and/or closed and/or sealed when/after mating/attachment. In an embodiment, the charging coil 54 is fixed on/in/at the faceplate 30. In an embodiment, a 2.4 GHz antenna is placed inside the hearing aid 10. In an embodiment, a 2.4 GHz antenna is fixed on/in/at/adjacent the faceplate 30. In an embodiment, a 2.4 GHz antenna is fixed in a standard shape as a part of the module M comprising the charging arrangement 50 and/or the button arrangement 60, 61 and/or the plunger/-s 70 and the microphone arrangement/-s 110. In an embodiment, a 2.4 GHz antenna is part of the module M comprising the charging arrangement 50 and/or the button arrangement 60, 61 and/or the plunger/-s 70 and the microphone arrangement/-s 110 at or adjacent or close to and/or in contact with and/or enclosed by the faceplate 30. In an embodiment, a 2.4 GHz antenna is fixed in a standard shape as part of the module M comprising the charging arrangement 50 and/or the button arrangement 60, 61 and/or the plunger/-s 70 and the microphone arrangement/-s 110 in the shell 20 at/adjacent/in or close to the faceplate 30. More than one antenna 54, 130 could be placed inside the hearing aid 10 as explained above, and one or more of these antennas may be configured to operate in a first frequency range, such as at a frequency above 800 MHz, and/or at a frequency above 1 GHz, e.g. at the frequency of 2.4 GHz above, and/or at a frequency between 1.5 GHz and 3 GHz, during use.

The faceplate 30 comprises a cavity 33 at its lower face 32 for at least partly and/or wholly/fully receiving and/or enclosing and/or touching/engaging the module M comprising at least one charging arrangement 50 and at least one microphone arrangement 110 and/or at least one button arrangement 60, 61 and/or at least one plunger 70. The faceplate cavity 33 is configured for facing the inner shell space 21. The charging arrangement 50 comprises at least one coil 54. Charging arrangement 50 comprises optionally one or more terminals 55 extending at and/or being exposed/accessible on the upper face 31 of faceplate 30, see FIG. 7.

The coil 54 comprises one or more windings 53, the one or more windings being provided circumferential of an inner cavity 52 of the coil with respect to a center axis CC of the coil (see FIGS. 2B, 4C, 4D, 5A, 5B, 6A and 6B).

The button arrangement 60 comprises at least one plunger 70 being operable through/via the upper face 31 of the faceplate 30, see FIGS. 1A-C, 2B, 4C, 4D, 5A, 5B, 6A and 6B. The button arrangement 60 is configured such that the plunger 70 in at least one position extends through the inner coil cavity 52 for engaging the IC 80.

The plunger 70 is adapted to activate a push button 61 on the integrated circuit 80 when the plunger is pushed towards the integrated circuit. The plunger 70 is configured to extend through the inner cavity 52 of the coil 54 along the coil center axis CC. One or more of the windings 53 of the coil 54 is/are configured to extend radially and/or axially around the inner coil cavity 52. Said plunger 70 is configured as a control knob adapted to activate said integrated circuit 80 when turned. Said button arrangement 60, 61, 70 is configured to activate or deactivate the hearing aid 10.

The coil 54 is an antenna 130 for wireless communication. The coil 54 is configured for charging a battery 40 wirelessly. The coil 54 is an antenna 130 for wireless communications and/or configured for charging a battery 40 wirelessly, such as contactless.

For the contactless charging wireless power transfer is applicable by a number of different technologies for use such as inductive coupling, resonant inductive coupling, capacitive coupling, magneto dynamic coupling, microwaves, light waves, etc. The rechargeable battery/-ies 40 may be lithium-ion batteries, a silver-zinc battery, etc.

The hearing aid 10 comprises at least two microphone arrangements 110.

Said coil 54 comprises a body 51 having a cross-section being oval in a plane being perpendicular to the center/longitudinal axis CC of the coil. Said coil 50 comprises a body 51 having a cross-section being oval in a plane being perpendicular to a center/longitudinal axis CP of the plunger 70, see FIGS. 1B, 1C, 6A and 6B.

Said coil body 51 has a cross-section being oval, circular and/or elliptical in a plane being perpendicular to the center/longitudinal coil axis CC. Said coil body 51 has a cross-section being oval, circular and/or elliptical in a plane being perpendicular to the center/longitudinal axis CP of the plunger 70, see FIGS. 1B, 1C, 6A and 6B.

The shell 20 is adapted after a user's auditory canal such that the hearing aid when placed in the ear is always orientated in a specifically predetermined position such that the time delay between sound received by the microphone arrangements 110 gives an indication of direction from where the sound originate, see FIG. 3.

The coil 54 and its body 51 allow one or more or each of the microphone arrangement/-s 110 to be situated off-center and/or displaced relative and/or outside the body 51 in an embodiment. The coil 54 and its body 51 allow the microphone arrangement/-s 110 to be situated off-center and/or displaced relative and/or outside the oval and/or circular and/or elliptical shape of the coil body 51 in an embodiment. The coil 54 is configured for extending in an axial direction along a center/longitudinal axis CC of the coil.

One aspect of this disclosure concerns a hearing aid 10, wherein the microphone arrangements 110 are configured to be essentially situated horizontally during use. This is shown in FIG. 3 where two or more microphone arrangements 110 and associated audio channels 120 for receiving sound are aligned in a direction perpendicular to the long sides of FIG. 3 but in parallel with its short sides with the same orientation as the numerals corresponding to a horizontal direction.

The plunger 70 in at least one position extends through and beyond/past the inner cavity 52 and/or length/height L/H of the coil 54 for engaging the IC 80, see at least FIGS. 1A, 4B, 4D, 4F, 5B and 5D. The plunger 70 is at least partly made of a material being magnetizable.

The coil 54 has a radial/(physical) extension perpendicular to its centre axis CC being larger/greater than its longitudinal/(physical) extension along or in parallel with its centre axis, see FIGS. 6A and 6B. The coil 54 has in an embodiment a larger/greater width/breadth W/T as measured in a plane approximately perpendicular or perpendicular to its centre axis CC than its length as measured in a plane along or in parallel with its centre axis, see FIGS. 6A and 6B.

One aspect of this disclosure concerns a charging station 200 comprising a body 210 and a lid 300. The charging station 200 is configured to charge one or more hearing aids 10 according to any of the disclosed aspects/examples/embodiments by means of induction when the hearing aid/-s is/are coupled to the charging station. The charging station 200 comprises a coil (transmitting coil) configured for magnetizing the plunger 70 and thereby charging the hearing aid/-s 10 (via its receiving coil 54) when the charging station is coupled to the hearing aid/-s.

One aspect of this disclosure concerns a method of producing a charging station 200. The method comprises the steps of manufacturing a body 210 of the charging station 200; providing the body 210 with a cavity 220 being essentially shaped as the hearing aid's shell 20; manufacturing a lid 300 of the charging station 200; providing the lid 300 with a cavity 310 for receiving the hearing aid's face plate 30; providing the lid 300 with a charging device 320, the charging device 320 and the lid 300 being adapted to mate such that the charging device is able to charge the hearing aid 10 when the lid 300 is closed.

The hearing aid 10 comprises one or more control units 81 for controlling the functionality of the hearing aid 10 by being operatively connected to the other components of the hearing aid, among others the plunger 70, the IC 80 and the button arrangement 60, 61. The hearing aid 10 comprises one or more receivers, suspensions and/or wax/sound filters 90 and/or loud speakers 91 and/or conduits or channels 140 for operative connection and/or audio communication between the receiver/-s 90 and/or the loud speakers 91 and/or the control unit 81 and/or any other associated component. The control unit 81 for controlling the hearing aid 10 is operatively connected to other components including the microphones 110 and battery 40, such as electronics/electronic circuits and mechanical devices incl. electrical conduits etc., however, these entities working together for the operation of the hearing aid are possible to implement by use of many different types of components and parts being common knowledge for a skilled person and are therefore not explained in detail herein.

Each microphone arrangement 110 works as an input transducer and the functionality of the hearing aid 10 is explained shortly here as its function is common knowledge for a skilled person. Each microphone of the microphone arrangement 110 receives sound through an audio channel 120 and a filter 90 and outputs an analogue audio signal based on the acoustic sound signal arriving at the microphone 110 when the hearing aid 10 is operating. An analogue-to-digital converter converts the analogue audio signal into a corresponding digital audio signal for digital signal processing in the hearing circuit, such as a hearing loss processor that is configured to compensate a hearing loss of a user of the hearing aid 10. Preferably, the hearing loss processor comprises a dynamic range compressor well-known in the art for compensation of frequency dependent loss of dynamic range of the user often termed recruitment in the art. In this way, the hearing aid 10 may be configured to restore loudness, such that loudness of the hearing loss compensated signal as perceived by the user wearing the hearing aid 10 substantially matches the loudness of the acoustic sound signal arriving at the microphone 110 as it would have been perceived by a listener with normal hearing. Accordingly, the hearing loss processor outputs a digital hearing loss compensated audio signal. A digital-to-analogue converter then converts the digital hearing loss compensated audio signal into a corresponding analogue hearing loss compensated audio signal. An output transducer in the form of a receiver 91 converts the analogue hearing loss compensated audio signal into a corresponding acoustic signal for transmission via a loudspeaker 91 or the like (see below) towards an eardrum of the user, whereby the user hears the sound originally arriving at the microphone 110, however, compensated for the user's individual hearing loss. The hearing loss processor is operatively coupled to the control unit 81 and/or master control unit of the hearing aid 10 in a way being common knowledge to a skilled person.

The hearing aid 10 optionally includes a wireless communication unit 93, e.g. in the form of a radio chip connected to an antenna 130 and/or the coil 54 or the like working as an antenna, and configured to communicate wirelessly with other devices, e.g. in a hearing loss aiding network as is well-known in the art.

FIG. 1D schematically illustrates an example of a hearing aid 10 comprising one or more microphones 110 for receiving an input signal and converting it into an audio signal. The audio signal is provided to a processing unit 81, 92 for processing the audio signal and providing a processed output signal for compensating a hearing loss of a user of the hearing aid 10. A receiver 91 is connected to an output of the processing unit 92 and/or the control unit 81 for converting the processed output signal into an output sound signal, e.g. a signal modified to compensate for a user's hearing impairment. Typically, a receiver 91 comprises a transducer, and a receiver 91 is often referred to as a loudspeaker 91. The processing unit 92 may comprise elements such as amplifiers, compressors, noise reduction systems, etc. The hearing aid 10 may further comprise one or more wireless communication units 93 for wireless data communication interconnected with an antenna structure 94, 130 and/or the control unit 81 for emission and reception of an electromagnetic field. The wireless communication unit 93, such as a radio or a transceiver, connects to the processing unit 92 and/or the control unit 81 and the antenna structure 94, 130, for communicating with an electronic device, an external device, or with another hearing aid 10, such as another hearing aid 10 located in/on/at another ear of the user, typically in a binaural hearing system. The hearing aid 10 may comprise two or more antenna structures 94, 130, e.g. in cooperation/use with the coil 54 working as an antenna.

The hearing aid 10 may comprise one or more antennas 54, 94, 130 for radio frequency communication. The one or more antennas 54, 94, 130 may be configured to operate in a first frequency range, such as at a frequency above 800 MHz, such as at a frequency above 1 GHz, such as at a frequency of 2.4 GHz, such as at a frequency between 1.5 GHz and 3 GHz, during use. Thus, the first antenna 54, 94, 130 may be configured for operation in ISM frequency band. The first antenna may be any antenna capable of operating at these frequencies, and the first antenna may be a resonant antenna, such as monopole antenna, such as a dipole antenna, etc. The resonant antenna may have a length of lambda/4 or any multiple thereof, lambda being the wavelength corresponding to the emitted electromagnetic field.

The hearing aid 10 may comprise one or more wireless communications units 93 or radios. The one or more wireless communications units 93 are configured for wireless data communication, and in this respect interconnected with the one or more antennas 54, 94 for emission and reception of an electromagnetic field. Each of the one or more wireless communication units 93 may comprise a transmitter, a receiver, a transmitter-receiver pair, such as a transceiver, a radio unit, etc. The one or more wireless communication units 93 may be configured for communication using any protocol as known for a person skilled in the art, including Bluetooth, WLAN standards, manufacture specific protocols, such as tailored proximity antenna protocols, such as proprietary protocols, such as low-power wireless communication protocols, RF communication protocols, magnetic induction protocols, etc. The one or more wireless communication units 93 may be configured for communication using same communication protocols, or same type of communication protocols, or the one or more wireless communication units 93 may be configured for communication using different communication protocols.

The hearing aid 10 comprises optionally one or more charging control units that could be the control unit 81 or another control unit to enable charging one or more hearing aids.

The charging station 200 comprises one or more charging control units 330 comprising one or more leads or conduits 331 for enabling leading power to one or more or both or each hearing aid 10 for charging one or more of them. The charging control units 330 of the charging station 200 cooperate operatively in some embodiments with the control unit/-s 81 of the hearing aid/-s 10 when applicable. The control, communication and charging control units 81, 92, 93, 330 for controlling the hearing aid 10 and its charging and/via the charging station 200 are operatively connected to each other and other components including one or more batteries 40, such as electronics/electronic circuits and/or mechanical devices incl. electrical conduits etc. when applicable, to safely operate the hearing aid/-s 10 and/or charge the battery/-ies in each hearing aid.

The hearing aid 10 comprises one or more audio channels 120. In some embodiments, the plunger 70 is configured as a core for the coil 54. In some embodiments, the coil 54 is a flat and/or planar coil. In some embodiments, the coil 54 is a flat coil having a larger lateral extension W/T than its length L or height or vertical thickness L/H, see at least FIGS. 1A, 6A and 6B. The lateral extension of the coil 54 is measured across or in a direction essentially perpendicular or perpendicular or at least somewhat angled or diverging in relation to the longitudinal direction of the hearing aid 10. Length L or height or thickness L/H of the coil 54 is measured along the longitudinal direction of the hearing aid 10 or at least measured along a direction being essentially in parallel with or in parallel with or at least close to parallel with the longitudinal direction of the hearing aid and if this direction is seen as a vertical direction the length or height or thickness L/H of the coil 54 is a vertical dimension, e.g. vertical length or vertical height or vertical thickness. The plunger 70 is configured to protrude through the center of the charge coil 54 (between its windings 53) enabling the architecture and space of small parts and components/hardware making up the hearing aid 10 to be compressed and/or reduced in size enabling making for example a smaller faceplate 30 having less visibility for a user. The coil 54 is mounted concentric to a faceplate mounted control interface of the hearing aid 10 enabling access for external control and visible cues to subsurface mounted location, i.e. below the faceplate 30. This enables making a more compact hearing aid 10.

According to an aspect, in the charging station 200 comprising a body 210 and one or more lids 300 and being configured to charge one or more hearing aids 10 according to any of the disclosed aspects/embodiments by means of induction when the hearing aid/-s is/are coupled to the charging station, the body 210 of the charging station is configured to guide or steer or orientate or turn or align the hearing aid/-s 10 (i.e. its shell 20) when introduced, i.e. received in a corresponding cavity 310 of the charging station, at least roughly into a closely correct or almost correct position as a preparation for a finalized position in the cavity and one or more of the lids 300 of the charging station is configured to guide or steer or orientate the whole hearing aid/-s 10 further/to a higher degree as/when/after its shell 20 is introduced/received in the cavity 310 of the charging station with a finer or vernier or final control into a final set charging position of the hearing aid/-s when the lid is closed.

In an embodiment, the module M comprising at least the charging arrangement 50 and the at least one microphone arrangement 110 is configured to be enclosed fully inside the cavity 33 of the faceplate 30, see e.g. FIG. 5D. In an embodiment, the module M comprising at least the charging arrangement 50 and the at least one microphone arrangement 110 is configured to be enclosed at least partly inside the cavity 33 of the faceplate 30. In an embodiment, the module M comprising at least the charging arrangement 50, 54 and the at least one microphone arrangement 110 is configured to be enclosed at least partly inside the inner space 21 of the shell 20. In an embodiment, the module M comprising at least the charging arrangement 50, 54 and the at least one microphone arrangement 110 is configured to be enclosed at least partly inside the cavity 33 of the faceplate 30 and at least partly inside the inner space 21 of the shell 20. In an embodiment, the module M comprising at least the charging arrangement 50, 54 and the at least one microphone arrangement 110 is configured to be arranged flush with the lower face 32 of the faceplate 30, see e.g. FIG. 5D.

The person skilled in the art realizes that the present disclosure is not limited to the preferred embodiments described above and below, i.e. the person skilled in the art further realizes that modifications and variations are possible within the scope of appended claims, for example, only one hearing 10 is possible to charge and/or two hearings aids 10 at the same time as shown in FIG. 7, or, in some embodiments, one or more plungers 70 is adapted to activate one or more push buttons 61 on one or more integrated circuits 80 when the plunger/-s is/are only pushed or turned and pushed towards the integrated circuit/-s. According to some embodiments, one or more push buttons 61 thereby, via the easy access and handling of the plunger/-s 70, control various functions of the hearing aid 10 by activating or deactivating one or more integrated circuits 80 when the plunger/-s 70 is/are turned and/or pushed towards the IC/-s 80 and/or its/their push button/-s 61. According to some embodiments, one or more push buttons 61 thereby activates or deactivates one or more integrated circuits 80 and/or one or more control units 81 when the plunger/-s 70 is/are turned and/or pushed. Hence, the charging station 200 is adaptable in some aspects to only charge one hearing aid 10 or more and/or be adapted to only receive one or more hearing aids. The charger station 200 itself may be a rechargeable device configured to be charged by means of wireless or -wired charging. According to some embodiments, the order of turning and/or pushing the plunger/-s 70 to engage or disengage from the push button/-s 61 of the IC 80 can be reversed depending on the application in the hearing aid/-s 10, i.e. a plunger 70 is either first pushed and then turned or first turned and then pushed if both movements are used or both movements are performed simultaneously if pushing the plunger 70 at the same time turns it or if the turning at the same time pushes the plunger, e.g. as a threading-like movement or the like. Pushing the plunger 70 is possible to perform similar to a one click or a two click, such as firstly pushing the plunger inwards towards the integrated circuit and when the push force on the plunger is released, the plunger springs back and then a second and/or more pushes and/or releases of the plunger is/are done. Pushing and/or releasing the plunger 70 is possible to combine with turning the plunger, e.g. first clockwise and then counter-clockwise and/or first turning the plunger a first distance/angle or length of arc and then a second distance/angle or length of arc in the same direction, this second turn could instead be in a direction opposite the first direction. The movements of a plunger 70 towards/from IC 80 and its push button/-s 61 enable controlling one or more hearing aids 10 by changing between and/or activating and/or deactivating different and/or one or more functions of hearing aids.

These small-sized hearing aids 10 also affect their freedom of design by at least somewhat limiting the dimensioning, i.e. "sizing", and designing the visible/exposed part, i.e. the faceplate 30, of a hearing aid when placed in the ear, this limitation being reduced by enabling a plunger 70 to reach through a coil 54 as defined herein.

Custom hearing aids 10 are hearing aids molded specifically for the ear canal of the specific user. The customized shell means that the internal volume of the hearing aid will be different for each hearing aid, which in turn means that the internal placement of components is a three-dimensional puzzle, e.g. as the hearing aids are small available space is scarce for placing components.

Items

1. A hearing aid 10 for placement in a user's ear canal, the hearing aid having a proximal end 1 and a distal end 2, the proximal end being the end of the hearing aid that is inserted into the user's ear canal and facing the tympanic membrane when inserted, the distal end being the opposite end, the hearing aid 10 comprising a shell 20 customised for the user's ear canal, the shell comprising an inner space 21 configured for at least partly receiving a rechargeable battery 40, a charging arrangement 50, 54, at least one microphone arrangement 110, 120, and an integrated circuit (IC) 80, a face plate 30 comprising an upper face 31 and a lower face 32 and a circumference, the upper face 31 being exposed at the distal end 2 of the hearing aid when the shell 20 is placed in the user's ear canal, the face plate being configured for closing the inner space 21 of the shell 20, wherein the IC 80 is arranged between the face plate and the proximal end 1, said charging arrangement 50, 54 being situated at the distal hearing aid end 2 and said battery 40 being situated between the IC and the proximal end 1.

2. The hearing aid 10 according to item 1, wherein the charging arrangement 50 and at least one microphone arrangement 110 are produced as one module (M).

3. The hearing aid according to item 2, wherein the faceplate 30 comprises a cavity 33 at its lower face 32 for at least partly receiving said module M, the faceplate cavity 33 being configured for facing the inner shell space 21.

4. The hearing aid 10 according to any preceding item, further comprising a coil 54 configured for wireless communications and/or wireless charging the battery 40.

5. The hearing aid 10 according to any preceding item, wherein the charging arrangement 50 comprises terminals 55 extending at the upper face 31 of the faceplate 30.

6. The hearing aid 10 according to any preceding item, further comprising a button arrangement 60, 61 comprising a plunger 70 being operable through the upper face 31 of the faceplate 30.

7. The hearing aid (10) according to any preceding item and item 4, wherein the coil (54) comprises one or more windings (53), the one or more windings being provided circumferential of an inner cavity (52) of the coil with respect to a center axis (CC) of the coil.

8. The hearing aid (10) according to items 6 and 7, wherein the plunger (70) is configured to extend through the inner cavity (52) of the coil (54) along the coil center axis (CC).

9. The hearing aid 10 according to item 7 or 8, wherein one or more of the windings 53 of the coil 54 is/are configured to extend radially and/or axially around the inner coil cavity 52.

10. The hearing aid 10 according to any preceding item and item 6, wherein the plunger 70 is configured as a control knob adapted to activate the IC 80 when turned and/or pushed.

11. The hearing aid 10 according to any preceding item and item 6, wherein the button arrangement 60, 61 is configured to control and/or activate and/or deactivate the hearing aid.

12. The hearing aid (10) according to any preceding item, wherein the coil (54) is an antenna (130) for wireless communication.

13. The hearing aid (10) according to any preceding item, wherein the coil (54) is configured for charging the battery (40) wirelessly.

14. The hearing aid (10) according to any preceding item, wherein the coil (54) is an antenna (130) for wireless communication and configured for charging the battery (40) wirelessly.

15. The hearing aid (10) according to any preceding item comprising at least two microphone arrangements (110).

16. The hearing aid (10) according to any preceding item and items 4 and 7, wherein the coil (54) comprises a body (51) having a cross-section being oval and/or circular and/or elliptical in a plane perpendicular to the center/longitudinal axis (CC) of the coil.

17. The hearing aid (10) according to any of items 7 or 8 to 16 when dependent on item 7, wherein the coil (54) has a radial/(physical) extension perpendicular to its centre axis (CC) being larger/greater than its longitudinal/(physical) extension along or in parallel with its centre axis.

18. The hearing aid (10) according to item 17, wherein the coil (54) has a larger/greater width/breadth (W/T) as measured in a plane perpendicular to its centre axis (CC) than its length/height (L/H) as measured in a plane along or in parallel with its centre axis.

19. The hearing aid (10) according to any of items 15 to 18, wherein the shell (20) is adapted after a user's auditory canal such that the hearing aid when placed in the ear is always orientated in a specifically predetermined position such that time delay between sound received by the microphone arrangements (110) gives an indication of direction from where the sound originate.

20. The hearing aid (10) according to any of items 15 to 19, wherein the coil (54) and its body (51) allow the microphone arrangements (110) to be situated outside the cylindrical body.

21. The hearing aid (10) according to any of items 16 to 20, wherein the coil (54) and its body (51) allow the microphone arrangements (110) to be situated off center and/or outside the oval, circular and/or elliptical shape.

22. The hearing aid (10) according to any of items 4 to 21, wherein the coil (54) is a planar coil.

23. The hearing aid (10) according to any of items 4 to 22, wherein the coil (54) is configured for extending in an axial direction along a center axis (CC) of the coil.

24. A hearing aid (10) according to any preceding item and item 15, wherein the microphone arrangements (110) are essentially situated horizontally during use.

25. The hearing aid (10) according to any preceding item and item 6, wherein the plunger (70) in at least one position extends through and beyond/past the length of the coil (54) and/or the inner cavity (52) of the coil for engaging the integrated circuit (80).

26. The hearing aid (10) according to any preceding item, wherein the plunger (70) is at least partly made of a material being magnetizable.

27. A charging station (200) comprising a body (210) and a lid (300), wherein the charging station is configured to charge a hearing aid (10) according to any of the preceding items by means of induction when the hearing aid is coupled to the charging station.

28. The charging station (200) according to item 29 comprising a coil configured for magnetizing the plunger (70) and thereby charging the hearing aid (10) when the charging station is coupled to the hearing aid.

29. A method of producing a charging station (200) according to item 27 or 28 comprising the steps of manufacturing a body (210) of the charging station (200), providing the body (210) with a cavity (220) being essentially shaped as the hearing aid's shell (20), manufacturing a lid (300) of the charging station (200), providing said lid with a cavity (310) for receiving the hearing aid's face plate (30), providing said lid with a charging device (320), the charging device (320) and said lid being adapted to mate such that the charging device is able to charge the hearing aid (10) when said lid (300) is closed.

30. The method according to item 29 comprising the steps of manufacturing a body (210) of the charging station (200), providing the body (210) with a cavity (220) being essentially shaped as the hearing aid's shell (20), manufacturing a lid (300) of the charging station (200), providing said lid with a cavity (310) being essentially shaped for receiving the hearing aid's face plate (30), providing said lid with a charging device (320), the charging device (320) and said lid being adapted to mate such that the charging device is able to charge the hearing aid (10) when said lid (300) is closed.

31. As used in this specification, the word "essentially" is used to describe a feature that does not vary in one or more aspects by 10%. For example, essentially horizontal refer to an orientation that is horizontal +/− within 10% (e.g., forming an angle with a horizon that is anywhere between −18° and 18°), wherein the value 18 is equal to 10% of 180°.

Although particular embodiments have been shown and described, it will be understood that they are not intended to limit the present inventions, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

The invention claimed is:

1. A hearing aid for placement in an ear canal of a user, the hearing aid comprising:

a shell;

a faceplate;

a coil arranged at the faceplate; and a plunger configured to control an integrated circuit arranged below the coil, the coil comprising one or more windings, the one or more windings being circumferential of an inner cavity of the coil with respect to a center or longitudinal axis of the coil, wherein at least a part of the plunger is in the inner cavity of the coil;

wherein the hearing aid has a first end and a second opposite from the first end, the first end being configured to be inserted into the ear canal and to face a tympanic membrane when the hearing aid is inserted into the ear canal, and wherein the hearing aid further comprises a battery situated between the integrated circuit and the first end; and wherein the plunger is configured to apply a mechanical force towards the integrated circuit.

2. The hearing aid according to claim 1, wherein the plunger is configured to activate a push button on the integrated circuit when the plunger is pushed towards the integrated circuit.

3. The hearing aid according to claim 1, wherein the plunger is configured as a control knob adapted to activate said integrated circuit when turned.

4. The hearing aid according to claim 1, wherein the plunger is configured to control and/or activate and/or deactivate the hearing aid.

5. The hearing aid according to claim 1, wherein the coil is an antenna for wireless communications and/or wireless charging the battery.

6. The hearing aid according to claim 1, wherein the plunger is operable through an outer side of the faceplate.

7. The hearing aid according to claim 1, further comprising at least two microphones.

8. The hearing aid according to claim 1, wherein the coil comprises a body having a cross-section, wherein the cross-section of the body of the coil has an oval, circular, or elliptical shape in a plane being perpendicular to the center or longitudinal axis of the coil.

9. The hearing aid according to claim 8, further comprising one or more microphone arrangements, wherein the coil allows the one or more microphone arrangements to be situated off-center from the body, and/or outside the body.

10. The hearing aid according to claim 8, further comprising one or more microphone arrangements, wherein the coil allows the one or more microphone arrangements to be situated off-center and/or outside the oval, circular or elliptical shape.

11. A hearing aid for placement in an ear canal of a user, the hearing aid comprising:

a shell;

a faceplate;

a coil arranged at the faceplate;

a plunger configured to control an integrated circuit arranged below the coil, the coil comprising one or more windings, the one or more windings being circumferential of an inner cavity of the coil with respect to a center or longitudinal axis of the coil, wherein at least a part of the plunger is in the inner cavity of the coil; and at least two microphones that are essentially situated horizontally during use.

12. A hearing aid for placement in an ear canal of a user, the hearing aid comprising:

a shell;

a faceplate;

a coil arranged at the faceplate; and a plunger configured to control an integrated circuit arranged below the coil, the coil comprising one or more windings, the one or more windings being circumferential of an inner cavity of the coil with respect to a center or longitudinal axis of the coil, wherein at least a part of the plunger is in the inner cavity of the coil;

wherein the plunger is configured to apply a mechanical force to the integrated circuit.

13. The hearing aid according to claim 1, wherein the plunger is at least partly made of a material being magnetizable.

14. The hearing aid according to claim 1, wherein the coil has a radial extension perpendicular to the center or longitudinal axis, the radial extension being larger than a longitudinal extension of the coil along or in parallel with the center or longitudinal axis.

15. The hearing aid according to claim 1, wherein the coil has a larger width/breadth (W/T) as measured in a plane perpendicular to the center or longitudinal axis than its length/thickness (L/H) measured in a plane along or in parallel with the center or longitudinal axis.

16. The hearing aid according to claim 1, wherein the plunger is configured to press a component on the integrated circuit.

17. The hearing aid according to claim 11, wherein the plunger is configured to apply a mechanical force towards the integrated circuit.

18. The hearing aid according to claim 11, wherein the plunger is configured to press a component on the integrated circuit.

19. The hearing aid according to claim 12, wherein the plunger is configured to press a component on the integrated circuit.

* * * * *